US012655688B2

(12) United States Patent
Ficken

(10) Patent No.: US 12,655,688 B2
(45) **Date of Patent: *Jun. 16, 2026**

(54) PACK SYSTEM FOR A DOWNHOLE ASSEMBLY

(71) Applicant: Park City Drilling Technologies LLC, Houston, TX (US)

(72) Inventor: Joe Ficken, Casper, WY (US)

(73) Assignee: Park City Drilling Technologies LLC

( * ) Notice: Subject to any disclaimer, the term of this patent is extended or adjusted under 35 U.S.C. 154(b) by 0 days.

This patent is subject to a terminal disclaimer.

(21) Appl. No.: 18/893,678

(22) Filed: Sep. 23, 2024

(65) Prior Publication Data

US 2025/0012149 A1 Jan. 9, 2025

Related U.S. Application Data

(62) Division of application No. 17/872,935, filed on Jul. 25, 2022, now Pat. No. 12,098,618.

(51) Int. Cl.
*E21B 4/00* (2006.01)

(52) U.S. Cl.
CPC ..... *E21B 4/003* (2013.01)

(58) Field of Classification Search
CPC ..... E21B 4/003
See application file for complete search history.

(56) References Cited

U.S. PATENT DOCUMENTS 1,368,570 A 2/1921 Philippeu
4,235,128 A 11/1980 Kanervo et al.
4,560,014 A 12/1985 Geczy
5,368,398 A 11/1994 Damm et al.
5,860,864 A 1/1999 Vukovic
6,158,533 A 12/2000 Gillis et al.
7,018,296 B2 3/2006 Rauschenbach et al.
8,033,917 B2 10/2011 Prill et al.
8,342,970 B2 1/2013 Altimas et al.
10,280,683 B1 5/2019 Smid
10,288,065 B1 5/2019 Smid et al.
(Continued)

OTHER PUBLICATIONS

Invitation to Pay Additional Fees for International (PCT) Patent Application No. PCT/US2023/070914, dated Oct. 24, 2023 3 pages.
(Continued)

*Primary Examiner* — Taras P Bemko
(74) *Attorney, Agent, or Firm* — Kendria Pearson; Laura Marmulstein

(57) ABSTRACT

A pack system for a downhole assembly is provided. One end of the pack system is connected to a drill bit for drilling a wellbore, the other end of the pack system interfaces with a motor to receive torque. The pack system described herein has a simple design that reduces the number of parts, eliminates some seals and shims, and relies on a portion of drilling mud for lubrication. As a result, wear on parts of the system is greatly reduced and the longevity of the system is greatly increased. The hardness of various components of the system in key areas is increased, for example, with carbide, to further reduce wear and increase longevity. In addition, the simpler, more balanced arrangement of components allows for reduced vibration and high rotational speeds, which improves the performance of the overall downhole assembly.

18 Claims, 34 Drawing Sheets

(56) References Cited

U.S. PATENT DOCUMENTS

| | | | |
|---|---|---|---|
| 10,612,316 | B2 | 4/2020 | Ritchie et al. |
| 12,098,618 | B2 | 9/2024 | Ficken |
| 2012/0275736 | A1 | 11/2012 | Foote et al. |
| 2015/0014059 | A1 | 1/2015 | Perry |
| 2015/0096809 | A1* | 4/2015 | Kerstetter ..... E21B 23/0419 175/100 |
| 2015/0176342 | A1 | 6/2015 | Ficken |
| 2016/0312534 | A1 | 10/2016 | Ficken |
| 2016/0333941 | A1 | 11/2016 | Touchette |
| 2020/0141186 | A1 | 5/2020 | von Gynz-Rekowski et al. |
| 2021/0140239 | A1 | 5/2021 | Miess et al. |
| 2021/0363834 | A1 | 11/2021 | Ficken |
| 2022/0098929 | A1 | 3/2022 | Merino |

OTHER PUBLICATIONS

International Search Report and Written Opinion for International (PCT) Patent Application No. PCT/US2023/70914, dated Jan. 3, 2024, 17 pages.
International Preliminary Report on Patentability for International (PCT) Patent Application No. PCT/US2023/070914, dated Feb. 6, 2025, 8 pages.
Official Action for U.S. Appl. No. 16/880,743, dated Sep. 30, 2021, 19 pages.
Official Action for U.S. Appl. No. 17/872,935, dated Oct. 10, 2023 8 pages Restriction Requirement.
Official Action for U.S. Appl. No. 17/872,935, dated Dec. 29, 2023 10 pages.
Notice of Allowance for U.S. Appl. No. 17/872,935, dated May 16, 2024 10 pages.

* cited by examiner

PACK SYSTEM FOR A DOWNHOLE ASSEMBLY

CROSS-REFERENCE TO RELATED APPLICATIONS

This application is a divisional of U.S. patent application Ser. No. 17/872,935, filed on Jul. 25, 2022, now U.S. Pat. No. 12,098,618, the disclosure of which is incorporated herein by reference.

FIELD OF THE INVENTION

Embodiments of the present invention generally relate to drilling into rock formations with a downhole assembly, and more specifically to a downhole assembly that includes a drive shaft that transmits torque to a mandrel and drill bit and that includes a bearing pack that supports the mandrel.

BACKGROUND OF THE INVENTION

Drive shafts, bearing packs, and mandrels are known in the drilling arts. The drive shaft transmits torque from a power source such as a mud motor to the mandrel. A drill bit is attached to the lower end of the mandrel, and the drill bit produces a cylindrical hole in the rock formations as the drill bit rotates. The bearing pack supports the mandrel as the mandrel experiences axial and radial forces. Furthermore, drilling mud flows through the downhole assembly and out of the end of the mandrel and drill bit to carry drill cuttings back to the surface and to cool components of the downhole assembly. Conventional downhole assemblies typically have many components such as seals and shims that increase the complexity of the downhole assemblies. This leads to more potential points of failure, causing the operator loss of operating time and increased costs. In addition, conventional downhole assemblies rotate at a slower speed and have components that routinely wear out, further increasing costs.

SUMMARY OF THE INVENTION

These and other needs are addressed by the various embodiments and configurations of the present invention. Embodiments of this invention specifically relate to a novel system, device, and method for providing a downhole assembly having fewer and more simplified components for ease of use, manufacturing, and replacement, which saves the operator considerable time and money.

It is one aspect of various embodiments of the present disclosure to provide a pack system with simplified bearing portions with fewer components and the elimination of some components, such as seals. During operation, the mandrel is subjected to large forces in the axial and radial directions. The pack system of the present disclosure includes a thrust bearing positioned between two radial bearings, and these bearings are disposed between the outer surface of the mandrel and the inner surface of at least one housing such as a bearing housing or a shaft housing. A portion of the drilling mud flows through the annular space between the mandrel and the at least one housing to cool and lubricate the bearings, and then the drilling mud flows out of the lower radial bearing and into the annular space surrounding the downhole assembly.

Each radial bearing comprises one portion connected to the mandrel and one portion connected to a housing, either the bearing housing or the shaft housing. An enhanced outer surface on the mandrel portion contacts or selectively contacts an enhanced inner surface on the radial bearings, thrust bearing, and/or housing portion to provide support in response to radial forces. The enhanced surfaces can be hardened carbide to handle contact at high speeds and/or with large forces. The upper radial bearing has a similar construction. The thrust bearing comprises races and ball bearings to provide support in response to axial forces. Thus, in some embodiments, the thrust bearing is a true axial bearing that ensures even wear in the vertical position and does not have race wear that can result in failure. A thrust ring between the thrust bearing and a shoulder of the bearing housing more evenly distributes forces around the mandrel. Drilling mud flows between the portions of the upper radial bearing, then flows through notches in the thrust ring and into the thrust bearing. The drilling fluid then flows between the portions of the lower radial bearing and out of the downhole assembly. This bearing portion is greatly simplified and has no seals, which results in less complexity and costs and increases reliability.

It is one aspect of various embodiments of the present disclosure to provide a pack system that results in less wear on its components. With the simplified bearing pack, the thrust bearing and its ball bearings are larger in size relative to, for instance, the bearing housing. Consequently, the larger thrust bearing turns slower and has less wear. In an exemplary embodiment, the internal components such as the mandrel and the portions of the radial bearings connected to the mandrel rotate between 80 and 120 revolutions per minute (RPM), and the outer components such as the housing and the portions of the radial bearings connected to the housings rotate between 40 and 60 RPM. Experiments show that this configuration results in no wear on the ball bearings when wear would have been expected. Moreover, the slowly turning thrust bearing can better support axial loads on the mandrel.

The enhanced surfaces of the radial bearing are hardened to better resist wear over time. In some embodiments, these enhanced surfaces are carbide with a Rockwell hardness over 60. In various embodiments, the carbide has a Rockwell hardness over 70. It will be appreciated that other surfaces within the overall system can be hardened to a Rockwell hardness over 60 to better resist wear over time.

It is a further aspect of embodiments of the present disclosure to provide a pack system with a properly balanced movement of components to reduce vibration, increase RPM, and resist wear over time. In some embodiments, the pack system is balanced such that the radial tools at the top equal the radial tools at the bottom, meaning there is not more radial support at the top than the bottom like prior art designs. This reduces the vibrations to almost zero, allows for higher RPMs with less heat, which means less wear and tear on the pack. The mandrel extends along a longitudinal axis, and in some embodiments, the lower radial bearing extends along a greater length of the longitudinal axis than the upper radial bearing. Moreover, a portion of the lower radial bearing is connected to the bearing housing while a portion of the upper radial bearing is connected to the shaft housing or no housing at all. As a result of one or both of these aspects of this configuration, there is reduced vibration in the moving components of the pack system, which reduces wear over time.

It is another aspect of embodiments of the present disclosure to provide a pack system that is easy to assemble. In prior art drilling packs, various components are dry fit together and then shims are added and subtracted to achieve in the final fit. Embodiments of the present disclosure do not need to incorporate shims. For example, a thrust ring is sized to fit between a shoulder of the bearing housing and an upper end of the thrust bearing. In various embodiments, the thrust ring is approximately 0.937 inches (2.380 cm) thick where the term "approximately" can imply a variation of +/−10% on a relative basis. This leads to a reduction in the number of components as well as a system that is easier to assemble, which saves time and cost on the job site. Moreover, human error is not introduced by using too few or too many shims when trying to achieve the final fit of the pack assembly.

It is an aspect of embodiments of the present disclosure to provide a shaft assembly with fewer components. In some embodiments, the shaft is a single, integrated component that replaces moving "rollers" with non-moving protrusions. These protrusions are described in greater detail herein and have a shape that allows the shaft to transmit torque to the mandrel with fewer moving parts, which increases the reliability of the overall system. In addition, the end of the shaft interfaces with a bearing adapter and the mandrel in a simple manner that reduces the number of parts. In some embodiments, the end of the shaft is positioned in a bronze seat in the bearing adapter. Then, a bonnet secures a split ring seal and another resilient seal against the bearing adapter. The resilient seal also interfaces with the shaft. This simple construction further increases the reliability of the system and makes assembling the components much easier.

In some embodiments, the shaft is case hardened, meaning the surface of the metal shaft is hardened while the metal deeper underneath remains soft, which forms a thin layer of harder metal at the surface. In various embodiments, the layer of harder metal is about 0.006" thick. In other embodiments, the layer of harder metal is between about 0.04" and 0.01" thick. In some embodiments, the shaft is heat treated. In other embodiments, the shaft is hardened using electric hardening. The surface of the shaft can be case hardened from about 38 Rockwell to about 60 Rockwell, or higher than 60 Rockwell.

One particular embodiment of the present disclosure is a pack system for use in a downhole assembly, the pack system comprising a mandrel extending between an upper end and a lower end, the mandrel having an outer surface and having an inner surface that defines a central cavity that extends from the upper end to the lower end; a thrust bearing disposed about the outer surface of the mandrel, the thrust bearing supports an axial load on the mandrel; a thrust ring disposed about the outer surface of the mandrel, the thrust ring having a lower end that contacts the thrust bearing, and the thrust ring distributes load forces about a circumference of the mandrel; a bearing housing disposed about the thrust bearing and the thrust ring, wherein an inwardly-extending shoulder of the bearing housing contacts an upper end of the thrust ring; a lower radial bearing that supports a radial load on the mandrel, wherein a part of the lower radial bearing contacts the thrust bearing to transfer the axial load through the thrust bearing to the thrust ring; and an upper radial bearing that supports the radial load on the mandrel, wherein a first portion of a drilling mud is configured to flow through the central cavity to cool a drill bit, and a second portion of the drilling mud is configured to flow through and lubricate the upper radial bearing, the thrust ring, the thrust bearing, and the lower radial bearing.

In some embodiments, the lower radial bearing comprises a lower male portion connected to the mandrel and comprises a lower female portion connected to the bearing housing, and the lower male portion is the part of the lower radial bearing that contacts the thrust bearing, wherein part of the outer surface of the lower male portion is an enhanced surface, and part of the inner surface of the lower female portion is an enhanced surface, and the second portion of the drilling mud is configured to flow between the enhanced surfaces of the lower male and lower female portions to support the radial load on the mandrel. In various embodiments, the enhanced surface of each of the lower male portion and the lower female portion is carbide with hardness greater than the remaining parts of the lower male portion and the lower female portion, respectively.

In some embodiments, the upper radial bearing comprises an upper male portion connected to the mandrel and comprises an upper female portion connected to the bearing housing, wherein an outer surface of the upper male portion is an enhanced surface, and an inner surface of the upper female portion is an enhanced surface, and the second portion of the drilling mud is configured to flow between the enhanced surfaces of the upper male and upper female portions to support the radial load on the mandrel. In various embodiments, at least one groove extends into an outer surface of the upper male portion to channel the second portion of the drilling mud into the upper radial bearing. In some embodiments, at least one notch extends into an outer surface of the thrust ring and at least one notch extends into an inner surface of the thrust ring to channel the second portion of the drilling mud from the upper radial bearing to the thrust ring.

In various embodiments, a ratio of an outer diameter of a ball bearing of the thrust bearing to an outer diameter of the bearing housing is greater than 0.08.

Another particular embodiment of the present disclosure is a shaft assembly for use in a downhole assembly, the shaft assembly comprising a bearing adapter extending from an upper end to a lower end, the bearing adapter having an inner surface that defines a shaft cavity extending into the upper end and having a threaded outer surface at the upper end, wherein the shaft cavity comprises a seat recess at a distal end of the shaft cavity and comprises a plurality of longitudinal channels; a seat positioned in the seat recess of the shaft cavity, the seat having a concave surface, and the seat is made of a material that is distinct from a material of the bearing adapter; a shaft extending from an upper end to a lower end, wherein the lower end of the shaft is positioned in the shaft cavity against the concave surface of the seat, the shaft having a plurality of non-moving protrusions extending outwardly from the shaft and positioned in the corresponding plurality of channels; a seal having a shaft portion and an end portion, wherein the shaft portion contacts an outer surface of the shaft, and the end portion contacts the upper end of the bearing adapter; and a bonnet threadably connected to the threaded outer surface at the upper end of the bearing adapter, wherein the bonnet holds the end portion of the seal against the upper end of the bearing adapter to seal the lower end of the shaft within the shaft cavity.

In some embodiments, the shaft assembly further comprises at least one split ring that contacts the end portion of the seal such that the end portion is positioned between upper end of the bearing adapter and the at least one split ring, wherein the bonnet comprises a shoulder that contacts the at least one split ring to press the at least one split ring into the seal. In various embodiments, the shaft extends from the upper end to the lower end along a longitudinal axis, and the seal contacts a seal portion of the shaft that has a constant outer diameter along the longitudinal axis. In some embodiments, a protrusion of the plurality of protrusions on the shaft has an elongated shape from a first end to a second end that is oriented parallel to a longitudinal axis of the shaft, and the protrusion has a top surface that curves outwardly between the first and second ends, wherein a first concave recess extending downwardly from a first side of the top surface, and a second concave recess extending downwardly from a second side of the top surface.

In various embodiments, an outer edge of the top surface has a first shape at the first end and has a second shape at the second end that is distinct from the first shape. In some embodiments, the protrusion has a fillet that transitions to the outer surface of the shaft, the first concave recess meets the fillet, and the second concave recess meets the fillet. In various embodiments, a channel of the plurality of channels has a concave shape that extends along an axis of the bearing adapter.

A further particular embodiment of the present disclosure is a pack system for use in a downhole assembly, the pack system comprising a mandrel extending between an upper end and a lower end, the mandrel having an outer surface and having an inner surface that defines a central cavity that extends from the upper end to the lower end; a bearing adapter connected to the upper end of the mandrel, the bearing adapter having at least one slot extending from an outer surface of the bearing adapter to an enclosed volume in the bearing adapter, wherein the enclosed volume is in fluid communication with the central cavity of the mandrel, the bearing adapter also having a shaft cavity at an upper end of the bearing adapter; a shaft operably engaged with the shaft cavity of the bearing such that a torque applied to the shaft is transmitted to the bearing adapter and to the mandrel, wherein a lower end of the shaft is positioned in the shaft cavity against a concave surface of a seat, the shaft having a plurality of protrusions extending outwardly from the shaft and positioned in corresponding plurality of channels of the shaft cavity; a bearing housing disposed about the mandrel to define an annular space between an inner surface of the bearing housing and the outer surface of the mandrel; and at least one bearing positioned in the annular space without seals to support at least one load on the mandrel, wherein a first portion of a drilling fluid is configured to flow through the at least one slot of the bearing adapter, the enclosed volume of the bearing adapter, and the central cavity of the mandrel to cool a drill bit, and a second portion of the drilling fluid is configured to flow through the annular space between the bearing housing and the mandrel to lubricate the at least one bearing.

In some embodiments, the at least one bearing comprises a lower radial bearing that supports a radial load on the mandrel and comprises a thrust bearing that supports an axial load on the mandrel. In various embodiments, the pack system further comprises a thrust ring positioned between the thrust bearing and a shoulder of the bearing housing, wherein the thrust ring distributes load forces about a circumference of the mandrel, and at least one notch extends into an outer surface of the thrust ring and at least one notch extends into an inner surface of the thrust ring to channel the second portion of the drilling mud into the thrust bearing. In some embodiments, the mandrel extends along a longitudinal axis, and the shaft extends along a shaft axis, and the longitudinal axis and the shaft axis form an angle greater than zero. In various embodiments, the mandrel, the bearing adapter, and the shaft rotate at a first speed, and the bearing housing rotates at a slower, second speed. In some embodiments, the first speed is between 80 RPM and 120 RPM, and the second speed is between 40 RPM and 60 RPM.

It will be appreciated by those skilled in the art that any component described in the present disclosure can be made from any strong and durable material. For example, metallic material, composite materials, ceramic materials, plastics, fiber reinforced composites or plastics, and other known materials used in the arts now or in the future. In one example, the components are manufactured from 4330 V steel and/or 4340 steel for their high strength values. It will be appreciated that all components may be manufactured from the same material or each component may be manufactured from the same or different material as each other.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

It is to be appreciated that any feature or aspect described herein can be claimed in combination with any other feature(s) or aspect(s) as described herein, regardless of whether the features or aspects come from the same described embodiment.

Any one or more aspects described herein can be combined with any other one or more aspects described herein. Any one or more features described herein can be combined with any other one or more features described herein. Any one or more embodiments described herein can be combined with any other one or more embodiments described herein.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The Detailed Description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Additionally, any combination of features shown in the various figures can be used to create additional embodiments of the present invention. Thus, dimensions, aspects, and features of one embodiment can be combined with dimensions, aspects, and features of another embodiment to create the claimed embodiment.

Figure 1:
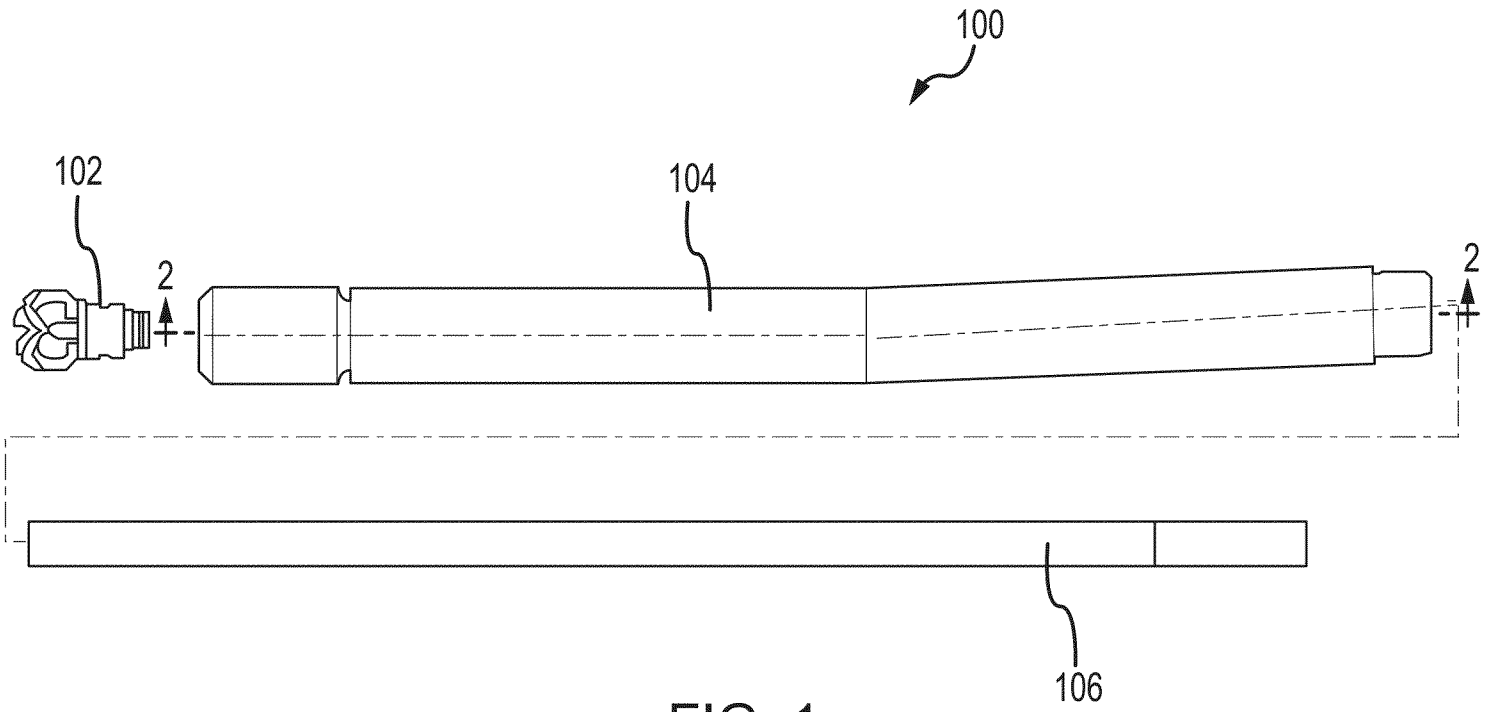
FIG. 1 is a side elevation view of a downhole assembly in accordance with an embodiment of the present disclosure.

FIG. 1 shows components of a downhole assembly 100 for use in a drill string. The downhole assembly 100 generally comprises a drill bit 102 at a distal end for cutting into the earth and forming a wellbore. The downhole assembly 100 also comprises a motor 106 for generating torque and a pack system 104 for transmitting torque from the motor 106 to the drill bit 102 among several other functions provided by the pack system 104, as discussed herein. As shown, the one or more casings that form the exterior of the pack system 104 can have a bend such that the axis of rotation of the drill bit 102 and the axis of rotation of the motor 106 form an angle greater than zero to allow steering of the downhole assembly 100 as the drill bit 102 cuts into a rock formation. Also shown in FIG. 1 is line 2-2.

Figure 2:
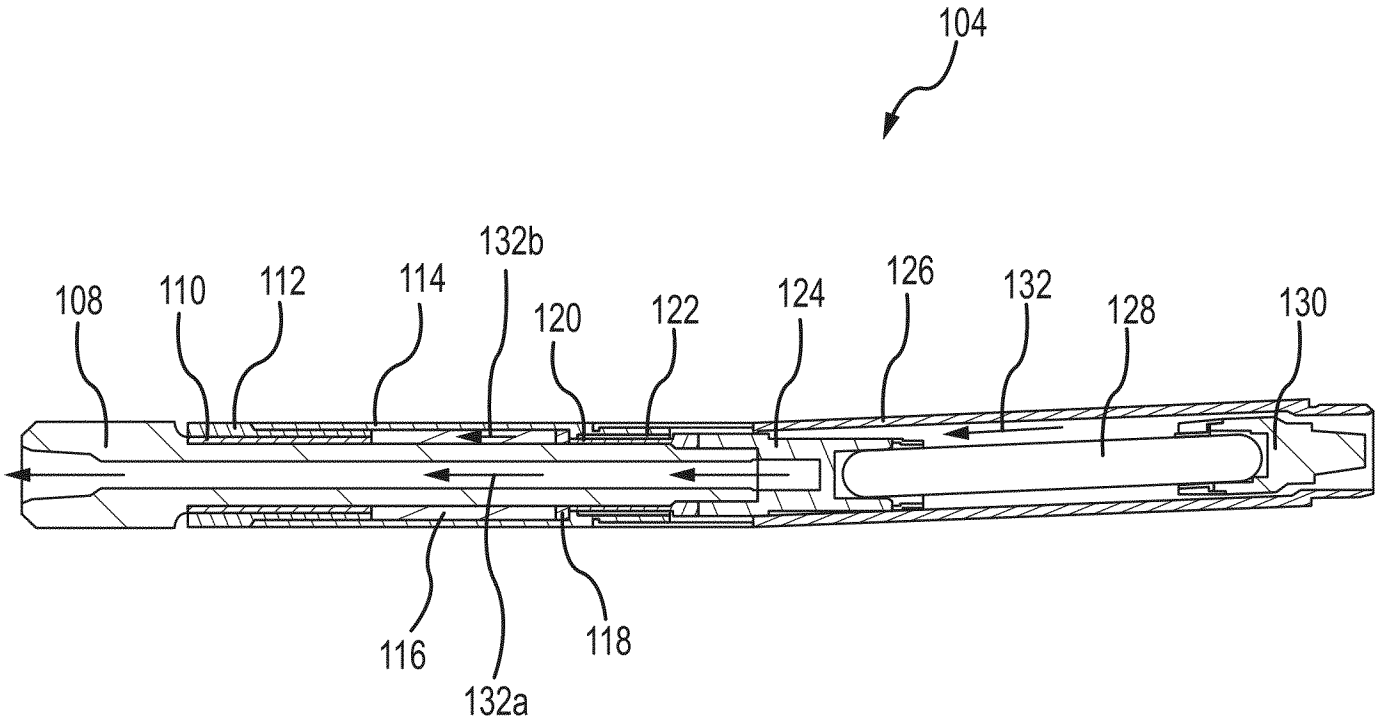
FIG. 2 is a cross-sectional view of the downhole assembly in FIG. 1 taken along line 2-2 in accordance with an embodiment of the present disclosure.

FIG. 2 shows a cross-sectional view of components of the pack system 104 in FIG. 1 taken along line 2-2. The components are arranged and oriented relative to each other to incur the many benefits described herein such as reduced wear, reduced vibration, faster rotational speed, increase longevity, etc. Starting at the lower end of the pack system 104, a mandrel 108 extends from an upper end (right side of FIG. 2, which is the end proximate the motor) to a lower end (left side of FIG. 2, which is the end proximate the drill bit). A drill bit selectively connects to the lower end of the mandrel 108 to receive torque from the mandrel 108. The mandrel 108 is positioned within at least one housing, such as the bearing housing 114 and the shaft housing 126, and a series of bearings are positioned between the outer surface of the mandrel 108 and the inner surfaces of the at least one housing to support the mandrel 108.

As the drill bit cuts into the earth, various loads are imposed on the mandrel that are extreme and variable in terms of direction and orientation. Accordingly, the mandrel 108 is supported by a lower radial bearing 110, 112, a thrust bearing 116, and an upper radial bearing 120, 122. The radial bearings support the mandrel 108 against radial loads, and the thrust bearing 116 supports the mandrel 108 against axial loads. The thrust bearing 116 is positioned between the radial bearings which reduces vibrations within the overall pack system 104 and allows for the mandrel 108 to rotate at a higher speed.

A lower male portion 110 connected to the mandrel 108 and a lower female portion 112 connected to the bearing housing 114 form the lower radial bearing. As described in further detail herein, the outer surface of the lower male portion 110 and the inner surface of the lower female portion 112 have enhanced surfaces made of hardened material such as carbide to help support the mandrel 108 against radial loads. Moreover, the lower radial bearing has a small gap between these enhanced surfaces where a portion of the drilling mud flows to lubricate the surfaces and help the lower radial bearing serve its function.

Next, a thrust bearing 116 is positioned adjacent to the lower radial bearing. Since the lower male portion 110 is connected to the mandrel 108, when the mandrel 108 experiences an axial load, the lower male portion 110 transmits the axial load to the thrust bearing 116, which supports the mandrel 108 against the axial load. As described herein, the thrust bearing 116 comprises races and ball bearings. In particular, the ball bearings are large relative to the bearing housing 114 to reduce wear and improve the longevity of the pack system 104.

A thrust ring 118 is positioned between the thrust bearing 116 and a shoulder of the bearing housing 114 to distribute forces about a circumference of the mandrel 108. As noted, the forces experienced by the mandrel 108 are variable in terms of direction and orientation, and the thrust ring 118 helps distribute these forces more evenly around the mandrel 108. In addition, the thrust ring 118 is sized to contact an upper end of the thrust bearing 116 and contact the shoulder of the bearing housing 114 without the use of shims, which further simplifies and reduces the number of components in the pack system 104 and reduces the human error associated with fitting the pack with the correct number of shims. The thrust ring 118 also has features that allow the passage of drilling mud as further described herein.

An upper male portion 120 and an upper female portion 122 form an upper radial bearing. As described in further detail herein, the outer surface of the upper male portion 120 and the inner surface of the upper female portion 122 have enhanced surfaces made of hardened material such as carbide to help support the mandrel 108 against radial loads. Moreover, the upper radial bearing has a small gap between these enhanced surfaces where a portion of the drilling mud flows to lubricate the surfaces and help the upper radial bearing serve its function.

Next, a shaft system transmits torque from a motor to the mandrel 108. A bearing adapter 124 is connected to the upper end of the mandrel 108, and a rotor adapter 130 is connected to the lower end of a rotor of the motor. A shaft 128 is operably connected to both adapters 124, 130 to transmit torque. As described in further detail herein, the shaft system has several features and aspects that reduce the number of parts and improves the longevity of the overall pack system 104.

During operation, drilling mud 132 flows through the drill string and enters a space within the shaft housing 126. A first portion 132*a* of the drilling mud, approximately 95% or more in some embodiments and 97% in further embodiments, flows through slots in the adapter bearing 124 and into a central cavity of the mandrel 108 where the drilling mud cools the drill bit and carries cuttings away to the surface. A second portion 132*b* of the drilling mud, approximately 5% or less in some embodiments and 3% in further embodiments, flows past the adapter bearing 124 to lubricate the various bearings. This second portion 132*b* flows in a gap within the upper radial bearing, flows through the thrust ring and thrust bearing, flows in a gap within the lower radial bearing, and out into the wellbore.

Figure 3B:
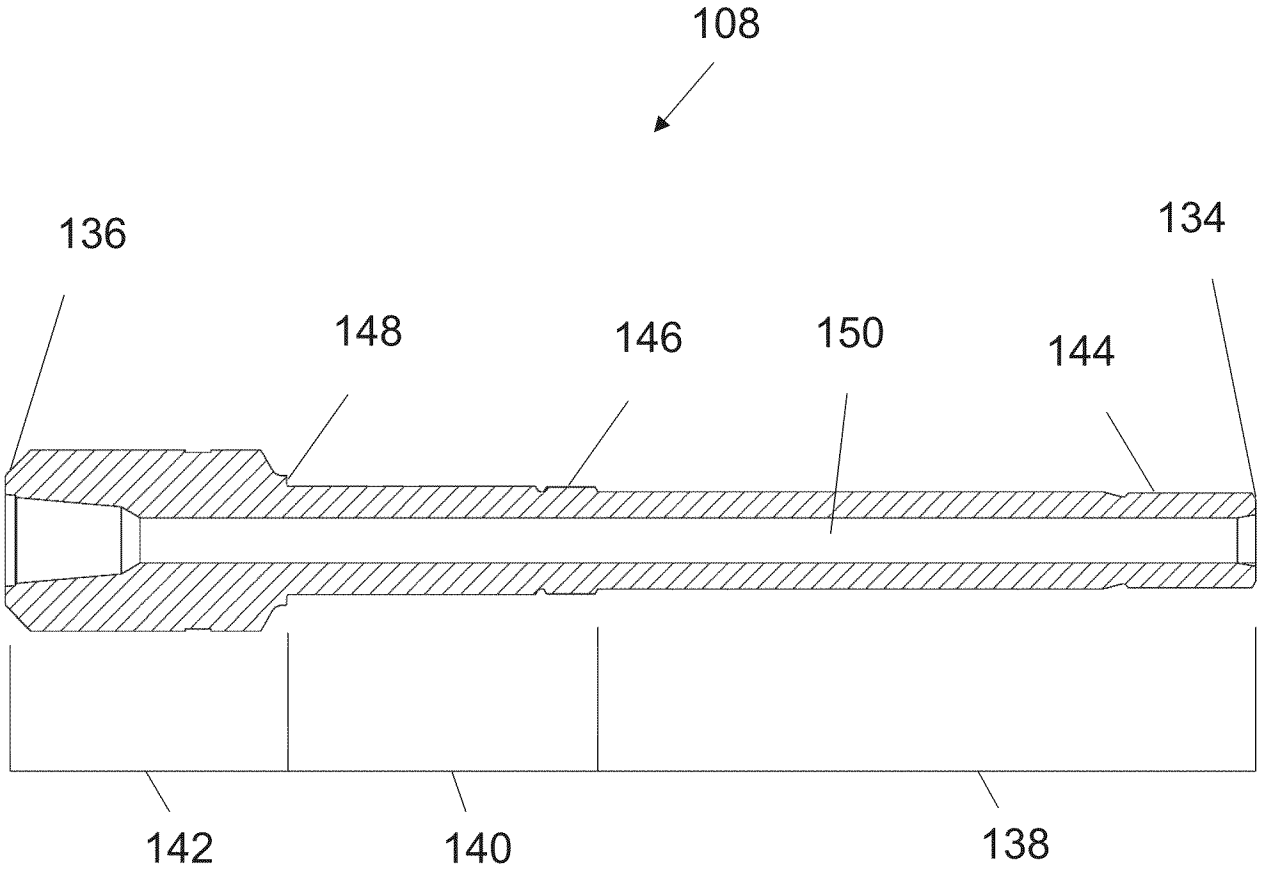
FIG. 3B is a cross-sectional view of the mandrel in FIG. 3A taken along line 3B-3B in accordance with an embodiment of the present disclosure.
Figure 3A:
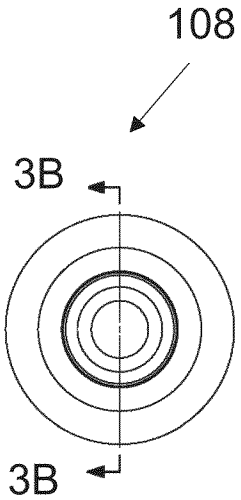
FIG. 3A is a front elevation view of a mandrel in accordance with an embodiment of the present disclosure.
Figure 19:
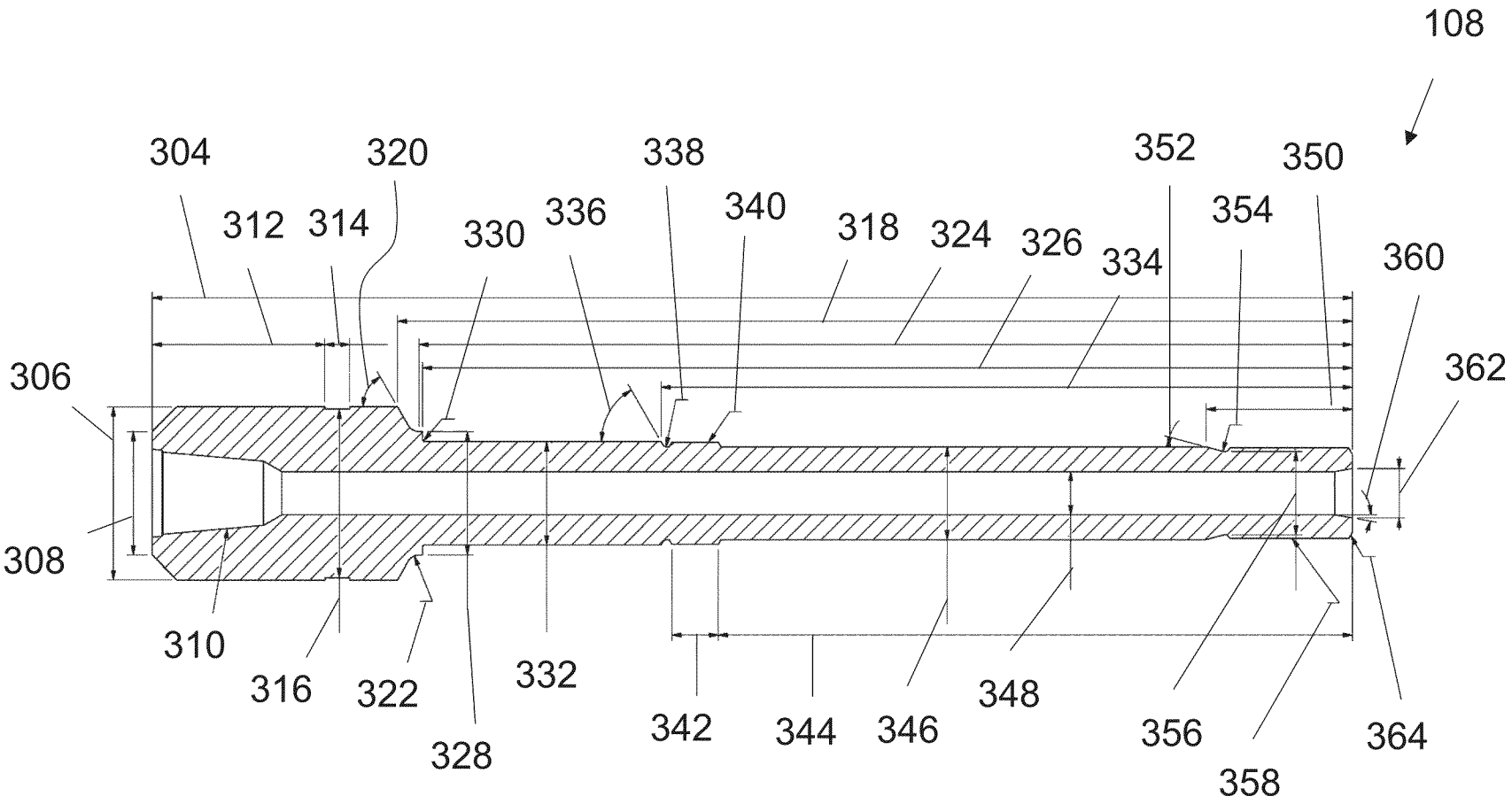
FIG. 19 is a cross-sectional view of a mandrel in accordance with an embodiment of the present disclosure.

FIGS. 3A and 3B show a front elevation view and a cross-sectional view, respectively, of a mandrel 108. The mandrel 108 extends from an upper end 134 to a lower end 136 and comprises an upper or first portion 138, a middle or second portion 140, and a lower or third portion 142. Each of these portions 138, 140, 142 has a generally constant outer diameter, but further details are shown in FIG. 19. A first threaded outer surface 144 spans part of the outer surface of the upper portion 138. Components such as the upper male portion of the upper radial bearing and the bearing adapter can selectively engage the first threaded outer surface 144. Similarly, a second threaded outer surface 146 spans part of the outer surface of the middle portion 140. The lower male portion of the lower radial bearing can selectively engage the second threaded outer surface 146.

Next, a shoulder 148 marks the transition between the middle portion 140 and the lower portion 142. The lower male portion can selectively engage the mandrel 108 such that a lower end of the lower male portion contacts the shoulder 148. Moreover, the lower radial bearing expels part of the drilling mud at the shoulder 148 and into the space surrounding the downhole assembly. The other part of the drilling mud is received at an opening at the upper end 134 of the mandrel 108 from the bearing adapter. The drilling mud flows through a central cavity 150 of the mandrel 108 that has a substantially constant inner diameter. The drilling mud then flows out of an opening at the lower end 136 of the mandrel 108 where the drilling mud cools the drill bit, which is connected to the lower end 136, and carries cuttings back to the surface.

Figure 4B:
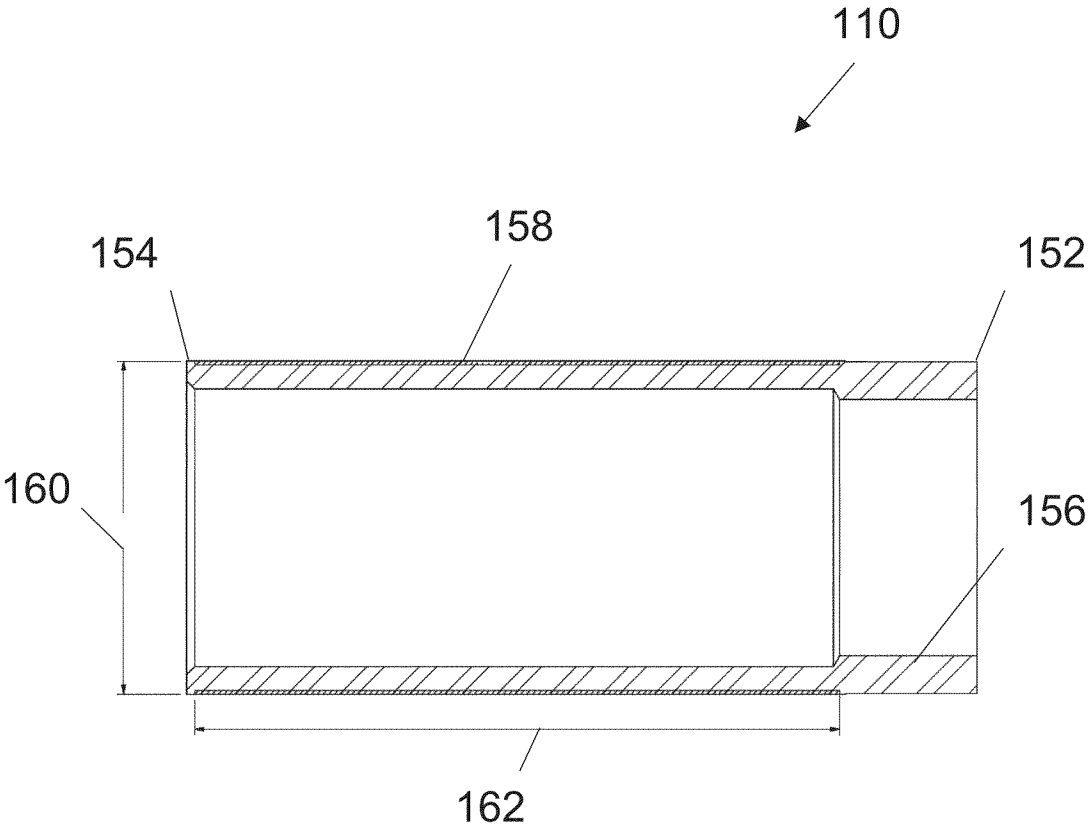
FIG. 4B is a cross-sectional view of the lower male portion in FIG. 4A taken along line 4B-4B in accordance with an embodiment of the present disclosure.
Figure 4A:
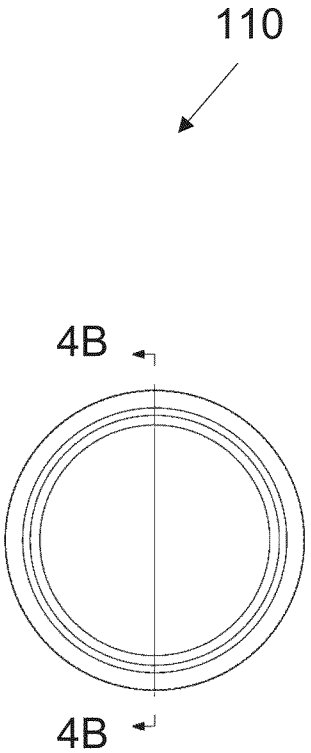
FIG. 4A is a front elevation view of a lower male portion of a lower radial bearing in accordance with an embodiment of the present disclosure.

FIGS. 4A and 4B show a front elevation view and a cross-sectional view, respectively, of a lower male portion 110 of a lower radial bearing. The lower male portion 110 extends from an upper end 152 to a lower end 154. A threaded surface 156 extends along part of the inner surface of the lower male portion 110 to selectively engage the mandrel. In addition, an enhanced surface 158 extends along part of the outer surface of the lower male portion 110. The enhanced surface 158 has a hardness that is greater than a hardness of the rest of the lower male portion 110. As discussed herein, the enhanced surface 158 contacts or selectively contacts a corresponding enhanced surface on the lower female portion. The enhanced surface 158 extends along a length 162 that is between approximately 9.5 and 10 inches (24.13 to 25.40 cm). In various embodiments, the length 162 is approximately 9.792 inches (24.87 cm). Moreover, the outer diameter 160 of the lower male portion 110 at the enhanced surface 158 is between approximately 4.9 and 5.1 inches (12.45 to 12.95 cm). In various embodiments, the outer diameter 160 is approximately 5.040 inches (12.80 cm).

Figure 5B:
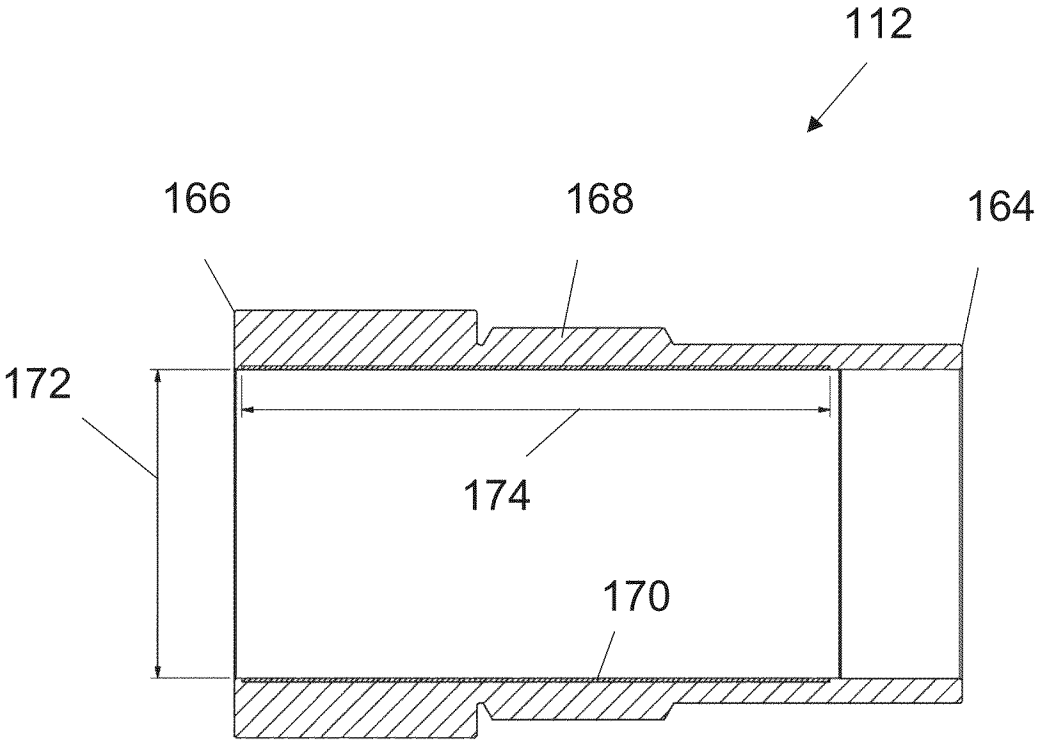
FIG. 5B is a cross-sectional view of the lower female portion in FIG. 5A taken along line 5B-5B in accordance with an embodiment of the present disclosure.
Figure 5A:
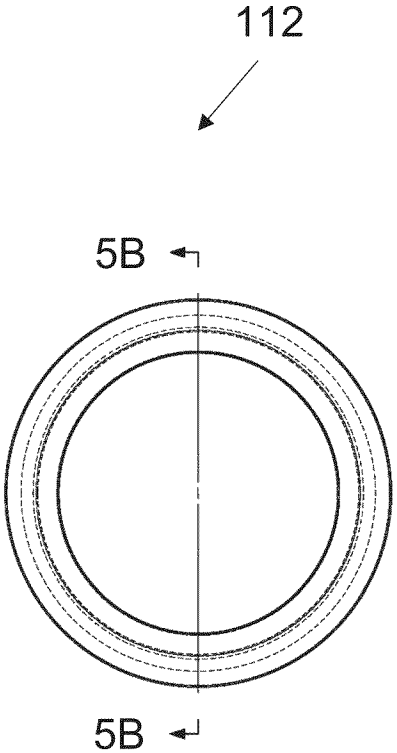
FIG. 5A is a front elevation view of a lower female portion of the lower radial bearing in accordance with an embodiment of the present disclosure.

FIGS. 5A and 5B show a front elevation view and a cross-sectional view, respectively, of a lower female portion 112 of a lower radial bearing where the lower female portion 112 and the lower male portion form the lower radial bearing. The lower female portion 112 extends from an upper end 164 to a lower end 166. A threaded surface 168 extends along part of the outer surface of the lower female portion 112 to selectively engage the bearing housing. In addition, an enhanced surface 170 extends along part of the inner surface of the lower female portion 112. The enhanced surface 170 has a hardness that is greater than a hardness of the rest of the lower female portion 112. As discussed herein, the enhanced surface 170 contacts or selectively contacts a corresponding enhanced surface on the lower male portion. Specifically, a drilling fluid passes through a small gap between the enhanced surface 170 and the lower male portion and without external forces, the enhanced surfaces 158, 170 of the lower male and female portions 110, 112 may not contact each other or may only contact each other sporadically. During operation, when the mandrel experiences loads, such as a radial load, the enhanced surfaces 158, 170 may contact each other to support the mandrel against the radial load.

The enhanced surface 170 of the lower female portion 112 extends along a length 174 that is between approximately 9.5 and 10 inches (24.13 to 25.40 cm). In various embodiments, the length 174 is approximately 9.7 inches (24.64 cm). In some embodiments, the length 174 of the enhanced portion 170 of the lower female portion 112 is approximately the same length as the length 162 of the enhanced portion 158 of the lower male portion 110. Moreover, the inner diameter 172 of the lower female portion 112 at the enhanced surface 170 is between approximately 4.9 and 5.1 inches (12.45 to 12.95 cm). In various embodiments, the inner diameter 172 is approximately 5.050+0.002/−0.000 inches (12.83+0.0005/−0.0000 cm). Thus, leaving a gap between enhanced surfaces of at least 0.01 inches (0.0254 cm) through which drilling mud flows.

Figure 6B:
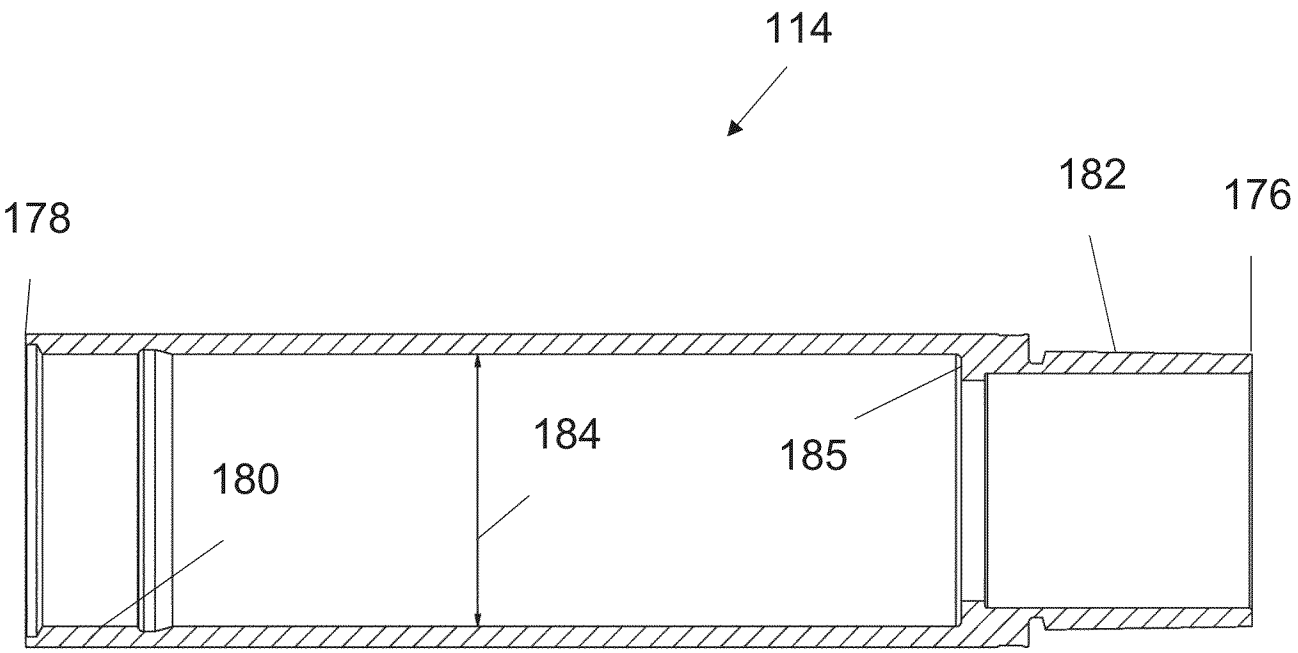
FIG. 6B is a cross-sectional view of the bearing housing in FIG. 6A taken along line 6B-6B in accordance with an embodiment of the present disclosure.
Figure 6A:
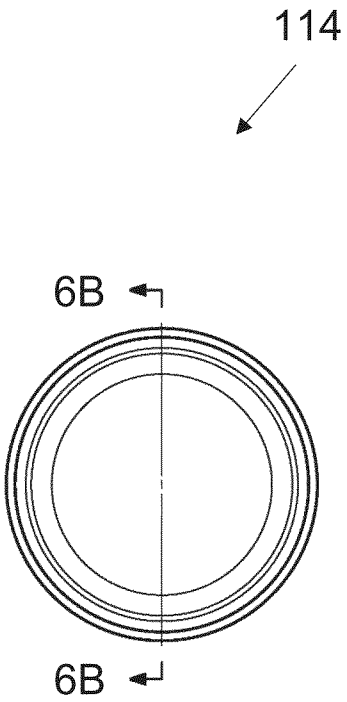
FIG. 6A is a front elevation view of a bearing housing in accordance with an embodiment of the present disclosure.

FIGS. 6A and 6B show a front elevation view and a cross-sectional view, respectively, of a bearing housing 114. The bearing housing 114 extends between an upper end 176 and a lower end 178. The bearing housing 114 has a threaded inner surface 180 at the lower end 178 to receive the lower female portion and has a threaded outer surface 182 at the upper end 176 to interface with, for example, a shaft housing. An inner diameter 184 spanning most of the bearing housing 114 is between 6 and 7 inches (15.24 to 17.78 cm). In some embodiments, the inner diameter 184 is 6.1+/−0.005 inches (15.49+/−0.0127 cm). The inner surface of the bearing housing 114 also defines a shoulder 185 that contacts other components, such as a thrust ring, as discussed herein.

Figure 7:
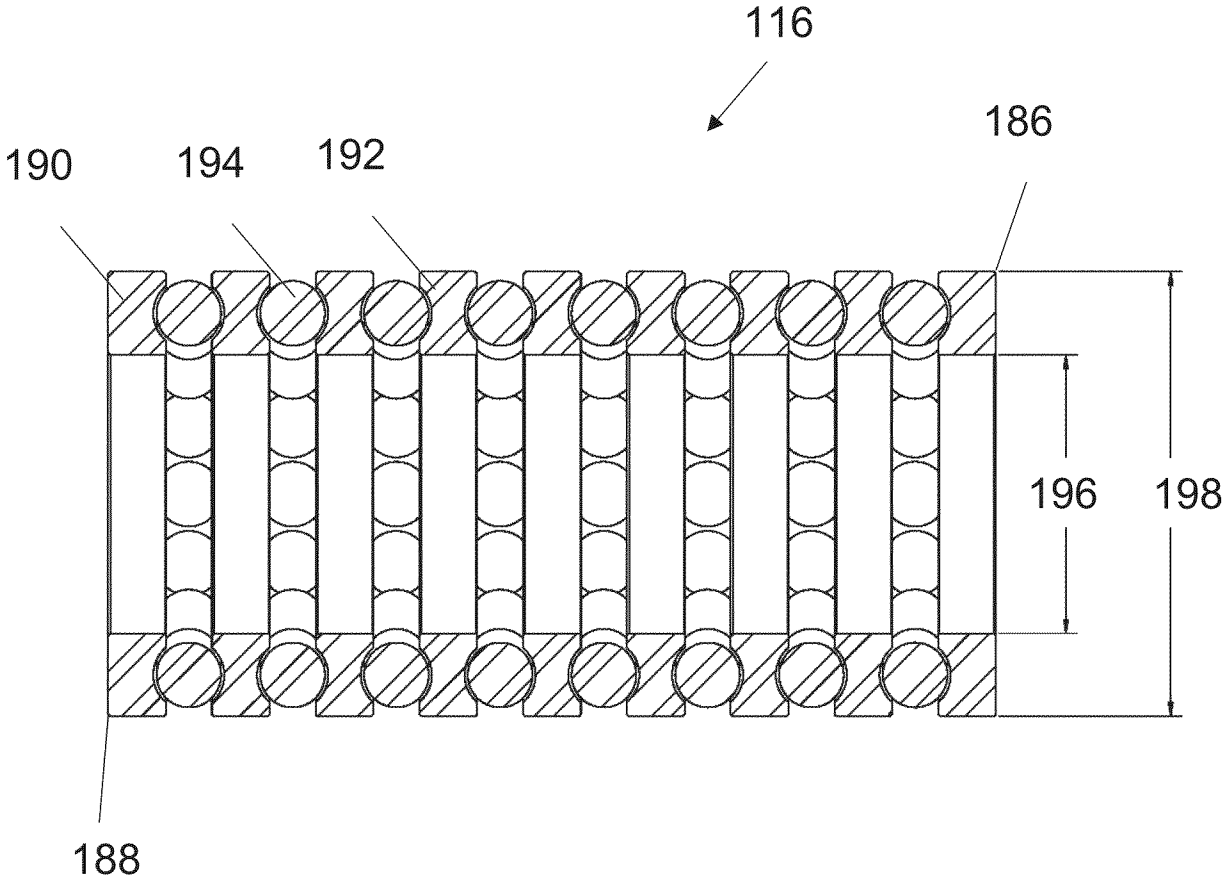
FIG. 7 is a cross-sectional view of a thrust bearing in accordance with an embodiment of the present disclosure.

FIG. 7 shows a cross-sectional view of a thrust bearing 116. The thrust bearing 116 extends from an upper end 186 to a lower end 188. In some embodiments, the lower end 188 receives an axial load from the lower male portion, and the upper end 186 transmits loads to a thrust ring. The thrust bearing 116 generally comprises end races 190 (two in this embodiment), inner races 192 (seven in this embodiment), and ball bearings 194 (128 in this embodiment) between the races 190, 192. Drilling mud can flow through and between the races and ball bearings to lubricate the thrust bearing 116.

An inner diameter 196 defined by the races 190, 192 is between approximately 3.5 and 4.0 inches (8.89 and 10.16 cm). In some embodiments, the inner diameter 196 is approximately 3.755+0.030/−0.000 inches (9.538+0.0762/−0.0000 cm). As the thrust bearing 116 is disposed about a middle portion of the mandrel, there is at least a 0.004 inch (0.01016 cm) gap between the thrust bearing 116 and the mandrel through which drilling mud can flow to cool and lubricate the components.

An outer diameter 198 defined by the races 190, 192 is between approximately 5.5 and 6.5 inches (13.97 and 16.51 cm). In some embodiments, the outer diameter 198 is approximately 6.0+0.000/−0.040 inches (15.24+0.000/−0.1016 cm). This leaves a gap between the outer surface of the thrust bearing 116 and the inner surface of the bearing housing of at least 0.095 inches (0.2413 cm) through which drilling mud can flow to cool and lubricate the components. It will be appreciated that the present disclosure encompasses embodiments with different numbers of races 190, 192 and ball bearings 194.

Moreover, the simplified design of the ball bearings 194 allows for larger ball bearings, which in turn results in less wear and a slower turning thrust bearing 116. In some embodiments, the outer diameter of a ball bearing 194 is approximately 0.8 inches (2.03 cm) where the term "approximately" can imply a variation of +/−10% on a relative basis, and the outer diameter of the bearing housing is approximately 7.0 inches (17.78 cm). Thus, the relative ratio of the outer diameter of a ball bearing 194 to the outer diameter of the bearing housing is approximately 0.11. In various embodiments, the ratio is greater than 0.08. In some embodiments, the ratio is between 0.1 and 0.2.

Figure 8B:
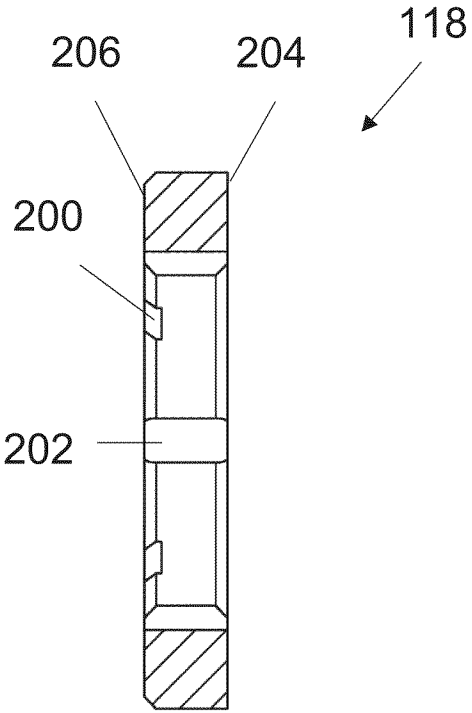
FIG. 8B is a cross-sectional view of the thrust ring in FIG. 8A taken along line 8B-8B in accordance with an embodiment of the present disclosure.
Figure 8A:
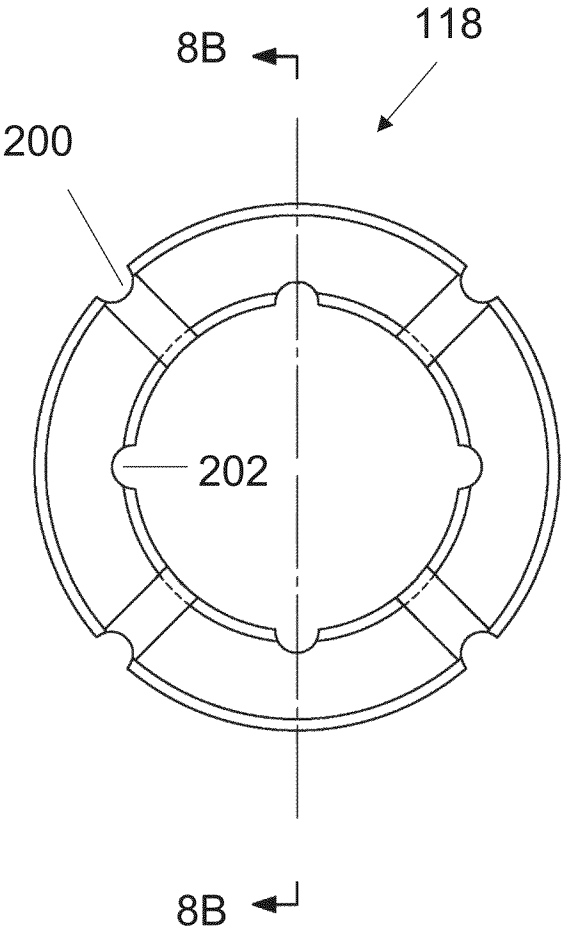
FIG. 8A is a front elevation view of a thrust ring in accordance with an embodiment of the present disclosure.

FIGS. 8A and 8B show a front elevation view and a cross-sectional view, respectively, of a thrust ring 118. The thrust ring 118 helps distribute forces about the mandrel, and the thrust ring 118 is sized to contact the thrust bearing and the shoulder of the bearing housing without the need for shims, reducing the number of parts within the overall pack system. The thrust ring 118 extends from an upper end 204 to a lower end 206, and the thrust ring 118 has a series of outer notches 200 and inner notches 202 that help channel drilling fluid from the upper radial bearing into the thrust ring 118.

Figure 9B:
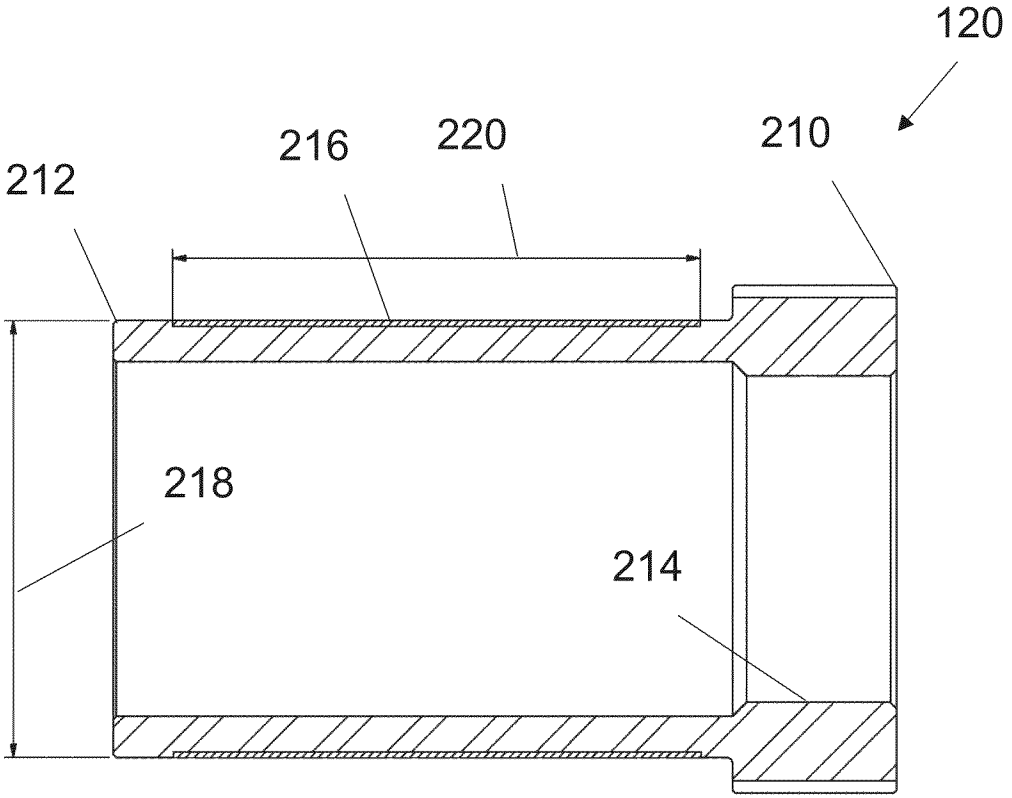
FIG. 9B is a cross-sectional view of the upper male portion in FIG. 9A taken along line 9B-9B in accordance with an embodiment of the present disclosure.
Figure 9A:
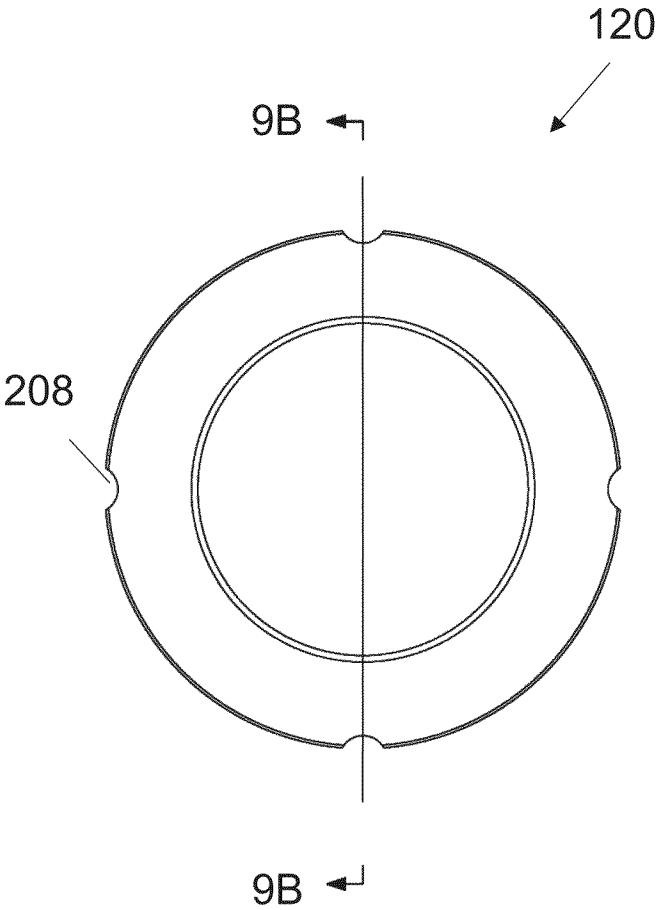
FIG. 9A is a front elevation view of an upper male portion of an upper radial bearing in accordance with an embodiment of the present disclosure.

FIGS. 9A and 9B show a front elevation view and a cross-sectional view, respectively, of an upper male portion 120 of an upper radial bearing. The upper male portion 120 has at least one groove 208 extending in an outer surface to channel a portion of the drilling mud into the upper radial bearing, and then into the thrust bearing and lower radial bearing. The upper male portion 120 also has a threaded inner surface 214 to selectively connect to the mandrel. An enhanced surface 216 extends along part of the outer surface of the upper male portion 120. This enhanced surface 216 contacts or selectively contacts an enhanced surface of an upper female portion, like the lower male and female portions.

The upper male portion 120 has an outer diameter 218 at the enhanced surface 216 that is between approximately 4.5 and 5.0 inches (11.43 to 12.70 cm). In some embodiments, the outer diameter is approximately 4.633 inches (11.77 cm). The enhanced surface 216 extends along a length 220 between approximately 5.5 to 6.0 inches (13.97 to 15.24 cm). In some embodiments, the length 220 is approximately 5.74 inches (14.58 cm).

Figure 10B:
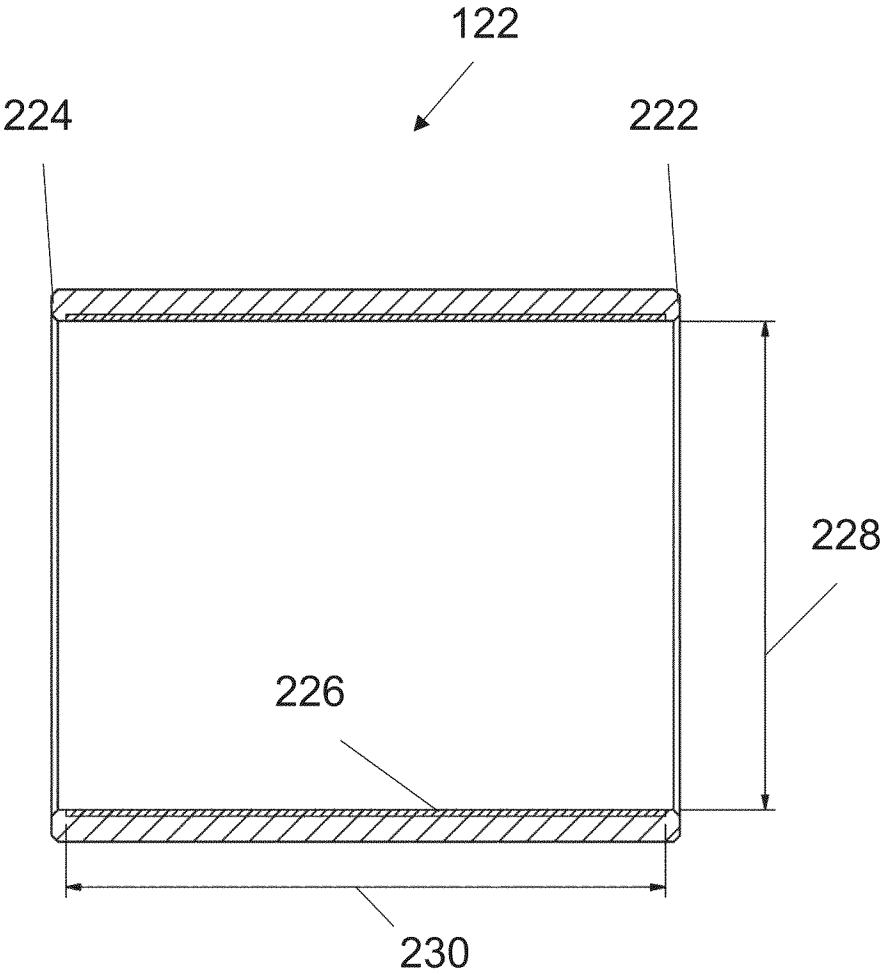
FIG. 10B is a cross-sectional view of the upper female portion in FIG. 10A taken along line 10B-10B in accordance with an embodiment of the present disclosure.
Figure 10A:
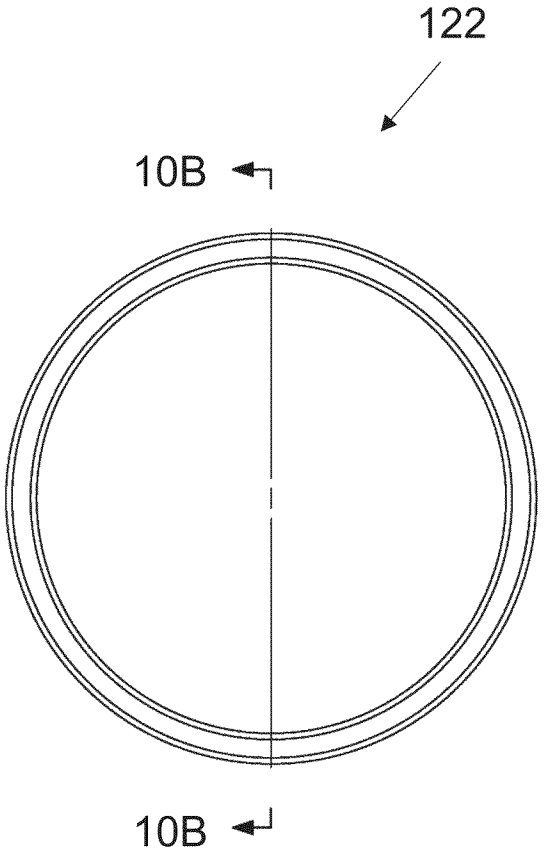
FIG. 10A is a front elevation view of an upper female portion of the upper radial bearing in accordance with an embodiment of the present disclosure.

FIGS. 10A and 10B show a front elevation view and a cross-sectional view, respectively, of an upper female portion 122. In some embodiments, the upper female portion 122 is threadably engaged with the bearing housing or the shaft housing. In other embodiments, the upper female portion 122 is not threadably engaged to any housing and freely rotates between the mandrel and a shaft housing. The upper female portion 122 along with the upper male portion 120 form an upper radial bearing like the lower male and female portions form the lower radial bearing. The upper female portion 122 has an enhanced surface 226 that along with the enhanced surface of the upper male portion function like the enhanced surfaces of the lower male and female portions.

The upper female portion 122 has an inner diameter 228 at the enhanced surface 226 that is between approximately 4.5 and 5.0 inches (11.43 and 12.70 cm). In some embodiments, the inner diameter 228 is approximately 4.645+/−0.002 inches (11.80+/−0.0051 cm). This results in a gap between the enhanced surfaces 216, 226 of the upper male and female portions 120, 122 that is at least 0.01 inch (0.0254 cm) through which drilling mud flows. The enhanced surface 226 has a length 230 that is between approximately 5.5 and 6.0 inches (13.97 to 15.24 cm). In some embodiments, the length 230 is approximately 5.725 inches (14.54 cm). In some embodiments, the length 220 of the enhanced surface 216 of the upper male portion 120 is approximately the same as the length 230 of the enhanced surface 226 of the upper female portion 122.

Figure 11:
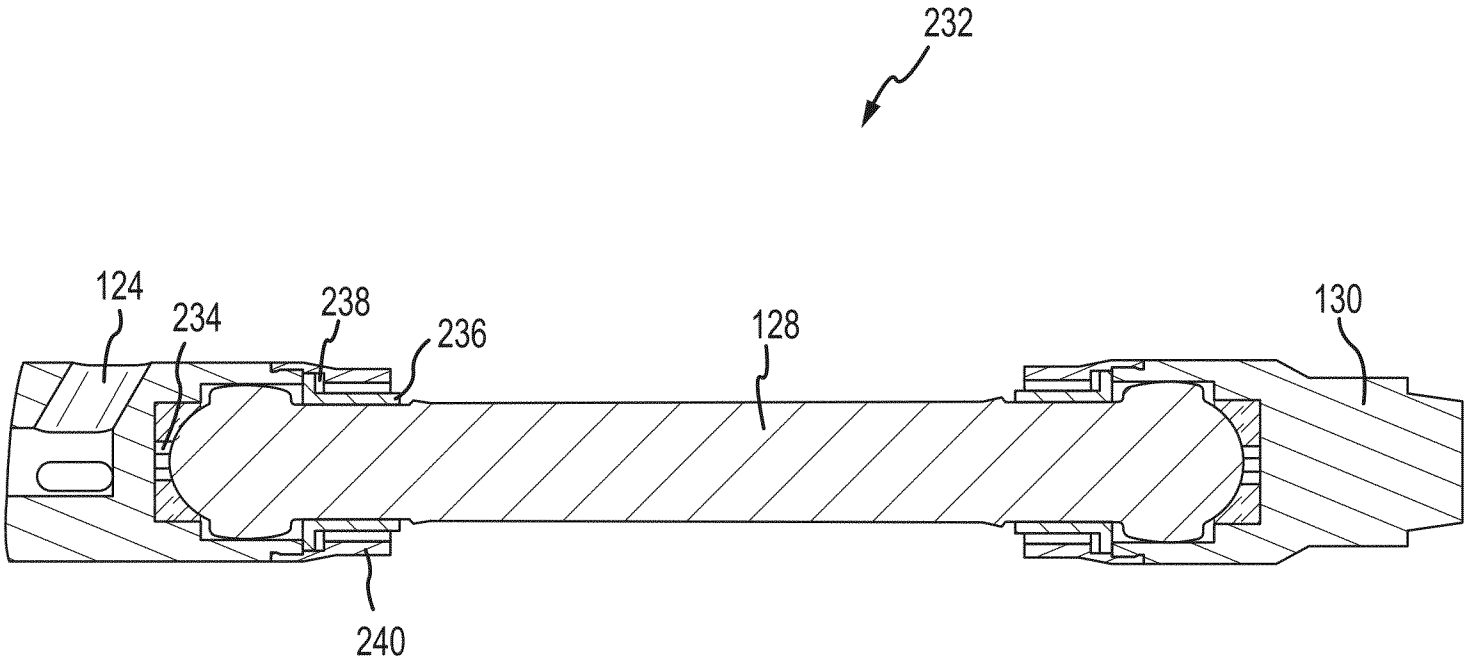
FIG. 11 is a cross-sectional view of a shaft assembly in accordance with an embodiment of the present disclosure.

FIG. 11 shows a cross-sectional view of a shaft assembly 232. The shaft assembly 232 transmits torque from a motor to the mandrel and drill bit. The shaft assembly 232 has fewer parts, fewer moving parts, and a simpler construction that improves the performance and longevity of the shaft assembly 232 as compared to shaft assemblies of the prior art. The bearing adapter 124 is connected to the upper end of the mandrel, the rotor adapter 130 is connected to a rotor of the motor, and a shaft 128 extends between the adapters 124, 130. The lower end of the shaft 128 contacts a seat 234 within the bearing adapter 124. The seat 234 is made from a material such as bronze to withstand the wear and rotational forces imposed by the rotating shaft 128.

Next, a seal 236 contacts an end of the bearing adapter 124 as well as a seal portion of the shaft 128. The portion of the seal 236 that contacts the shaft 128 has a substantially constant inner diameter along a length of the seal 236 for a simple and effective interface with the shaft 128. Similarly, the shaft 128 has a substantially constant outer diameter in the seal portion. The seal 236 separates grease within the bearing adapter 124 and the seat 234 from drilling mud that generally surrounds the shaft 128. In addition, the hydrostatic pressure within the system helps keep the drilling mud from entering the grease area.

The end of the seal 236 is positioned between the bearing adapter 124 and a split ring seal 238 where the split ring seal 238 is a more rigid material than the seal 236. A bonnet 240 has an inner shoulder that contacts the split ring seal 238 and presses the seals 236, 238 into the bearing adapter 124 and partially compresses the seal 236 for an effective overall seal. In some embodiments, there is at least ⅛" compression on the seal 236 or seals 236, 238. It will be appreciated that the shaft 128 is symmetric about a plane extending through a center of the shaft 128, where the plane is perpendicular to the longitudinal axis of the shaft 128. Thus, the upper end of the shaft 128 joins the rotor adapter 130 in a similar manner with a seat, a resilient seal, a split ring seal, and a bonnet.

Figure 12B:
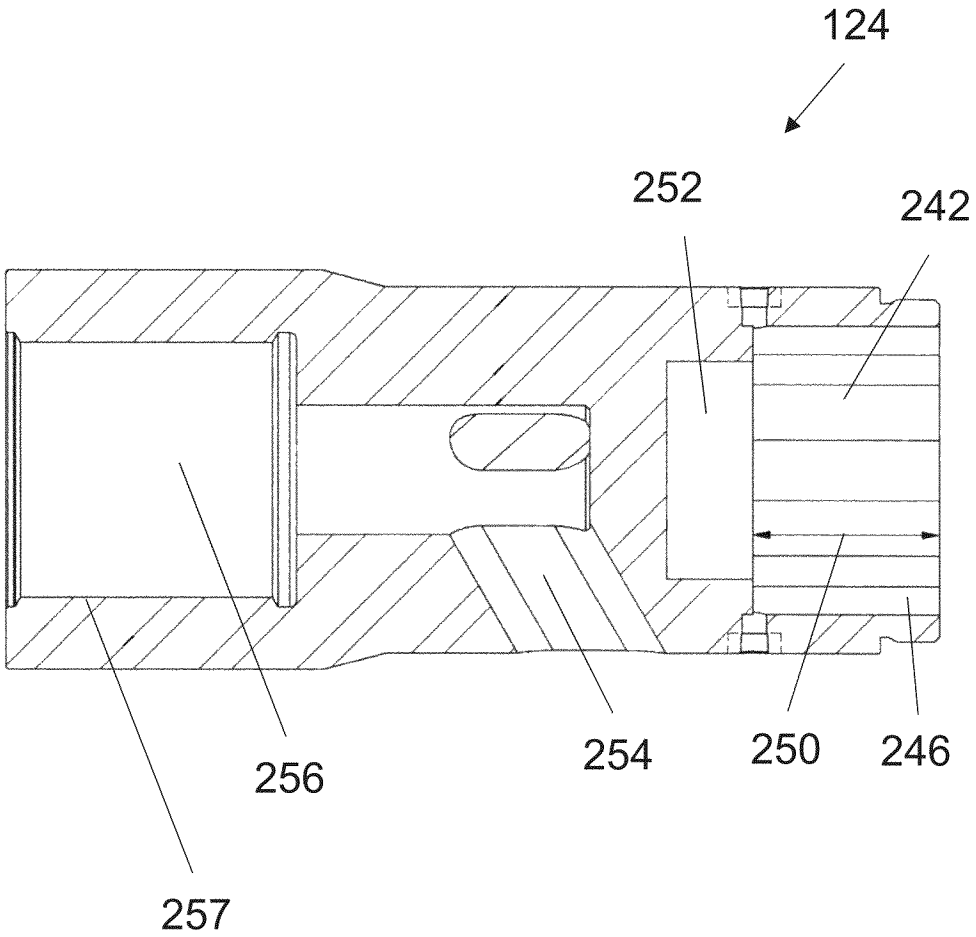
FIG. 12B is a cross-sectional view of the bearing adapter in FIG. 12A taken along line 12B-12B in accordance with an embodiment of the present disclosure.
Figure 12A:
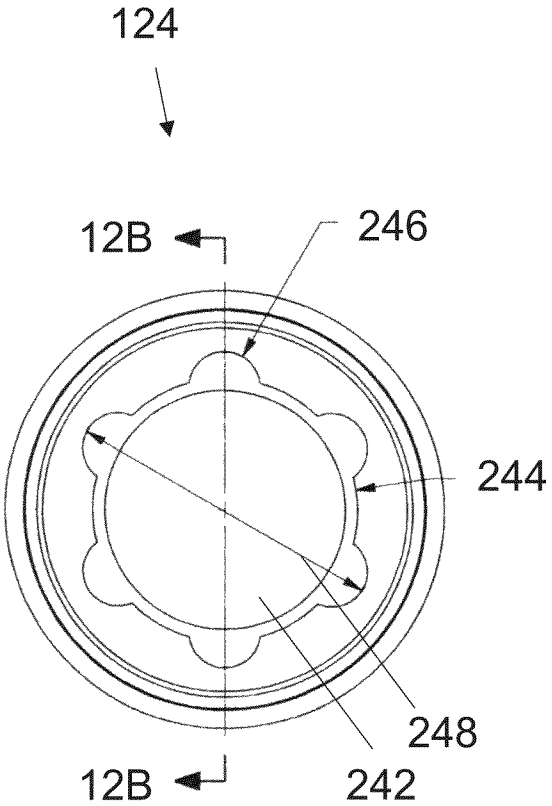
FIG. 12A is a front elevation view of a bearing adapter in accordance with an embodiment of the present disclosure.

FIGS. 12A and 12B show a front elevation view and a cross-sectional view, respectively, of a bearing adapter 124. Starting at an upper end (right side of FIG. 12B), the bearing adapter 124 has an inner surface that defines a shaft cavity 242 with a general inner diameter 244 of approximately 3.25 inches (8.26 cm). The inner surface also defines a series of channels 246 with a channel diameter of approximately 0.875 inches (2.223 cm). As a result, a maximum inner diameter 248 between opposing channels 246 is approximately 3.9 inches (9.906 cm). Referring to FIG. 12B, the channels 246 extend along a longitudinal direction of the bearing adapter 124 by a length 250 of 2.52 inches (6.4 cm). Further, a seat recess 252 is positioned at a distal end of the shaft cavity 242 to receive the seat described herein.

Next, a portion of the drilling mud is transmitted from outside of the bearing adapter 124 to inside of the bearing adapter 124. At least one slot 254 extends from an outer surface of the bearing adapter 124 to an enclosed volume 256. In some embodiments, three slots 254 are equally spaced about a longitudinal axis of the bearing adapter 124. Once in the enclosed volume 256, the drilling mud flows through a central cavity of the mandrel and out of the drill bit. Finally, the bearing adapter 124 is connected to the upper end of the mandrel via a threaded inner surface 257.

Figure 13A:
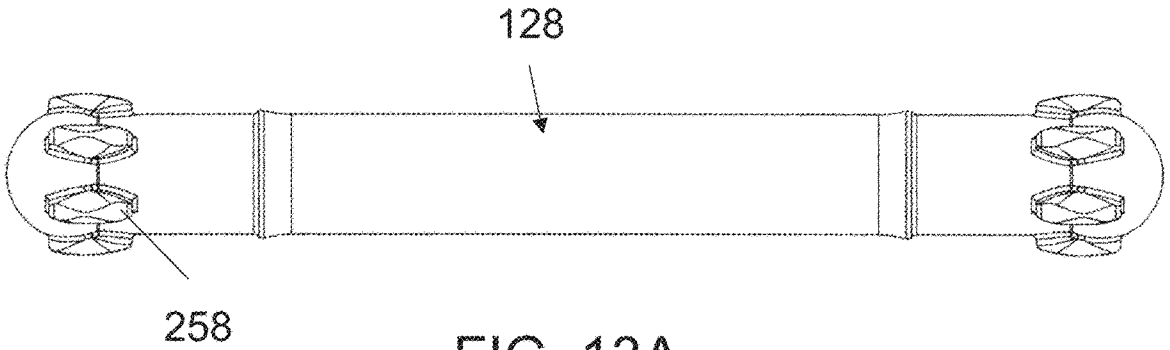
FIG. 13A is a side elevation view of a shaft in accordance with an embodiment of the present disclosure.
Figure 13B:
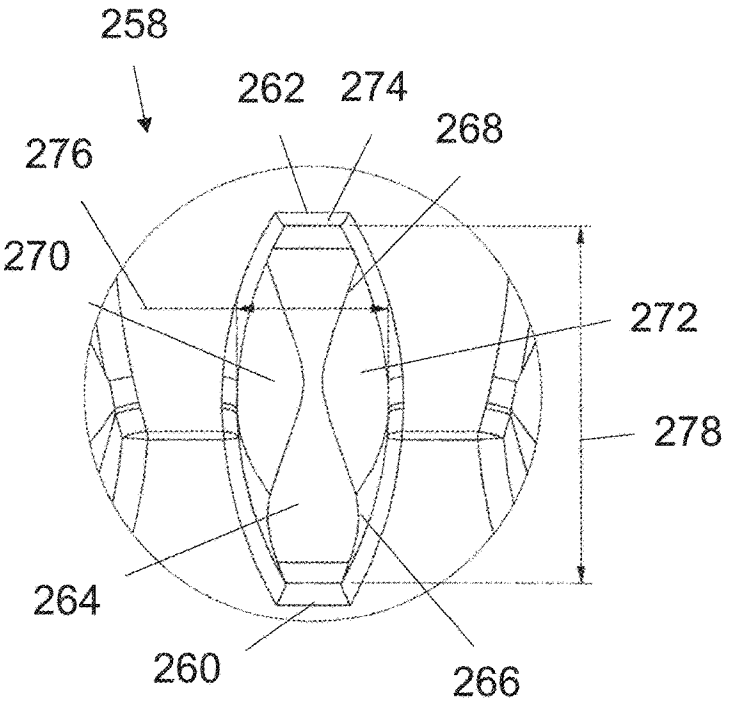
FIG. 13B is a top plan view of a protrusion of the shaft in FIG. 13A in accordance with an embodiment of the present disclosure.
Figure 13C:
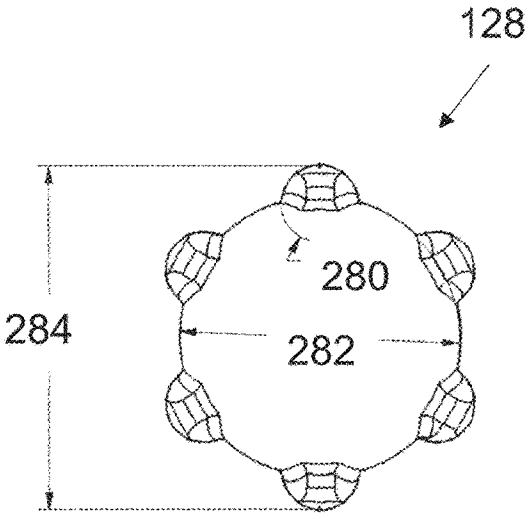
FIG. 13C is a front elevation view of the shaft in FIG. 13A in accordance with an embodiment of the present disclosure.

FIGS. 13A-13C show a side elevation view, a detailed view, and a front elevation view, respectively, of a shaft 128. The shaft 128 has a series of protrusions 258 that extend into the channels of the bearing adapter and rotor adapter, as described herein. The protrusions 258 are non-moving to reduce the potential points of failure in the overall shaft assembly. Moreover, the protrusions 258 have a particular shape that allow the shaft 128 to transmit torque from the motor to the mandrel, even when the axis of rotation of the motor is at an angle relative to the axis of rotation of the mandrel, specifically an angle greater than zero. The shape allows for the efficient and effective transmission of power without moving parts.

Referring to FIGS. 13B and 13C, an exemplary protrusion 258 extends between a first end 260 and a second end 262. The first end 260 is the upper end and the second end 262 is the lower end for the protrusions 258 at the bearing adapter, and vice versa for the protrusions 258 at the rotor adapter. The protrusion 258 has a top surface 264 that bows outward away from the shaft 258 between the ends 260, 262. Moreover, the outer edge that defines the top surface 264 has a first shape 266 at the first end 260 that comprises a curve. The outer edge also has a second shape 268 at the second end 262 that is distinct from the first shape 266 and comprises a straight line. Next, a first concave recess 270 extends downward from a first side of the top surface 264, and a second concave recess 272 extends downward from a second side of the top surface 264, leaving the top surface 264 with a smaller width at the center between the two shapes 266, 268 compared to the ends 260, 262. A fillet 274 transitions the protrusion 258 to the rest of the shaft 128. A width 276 of the protrusion 258 where each concave recess 270, 272 meets the fillet 274 is approximately 0.849 inches (2.16 cm), and a length 278 of the protrusion 258 between the ends 260, 262 is approximately 2.0 inches (5.08 cm).

Various dimensions of the protrusion 258 relative to parts of the adapters are crucial for the ability of the shaft to articulate and be oriented at different angles relative to the adapter while still efficiently transmitting torque. When viewed from the end, the protrusion 258 has an outer diameter 280 of 0.85 inches (2.16 cm), and the end of the shaft 128 has an outer diameter 282 of 3.125 inches (3.938 cm). Moreover, a distance 284 between opposing protrusions 258 is 3.845 inches (9.766 cm). This dimension is for the outermost points of the protrusions 258 since a top surface of a protrusion 258 bows outwardly, which allows for articulation of the shaft relative to the adapters.

Thus, the outer diameter 280 of the protrusion 258 is slightly less than a diameter of the channel 246. In various embodiments, the outer diameter 280 of the protrusion 258 is approximately 97.1% of the diameter of the channel 246. In some embodiments, the outer diameter 280 of the protrusion 258 is between approximately 97% and 97.5% of the diameter of the channel 246. Next, the outer diameter 282 of the end of the shaft 128 is slightly less than a diameter 244 of the shaft cavity 242. In various embodiments, the outer diameter 282 of the end of the shaft 128 is approximately 96.2% of the diameter 244 of the shaft cavity 242. In some embodiments, the outer diameter 282 of the end of the shaft 128 is between approximately 96% and 96.5% of the diameter 244 of the shaft cavity 242. The distance 284 between protrusions 258 is slightly less than a maximum diameter 248 of the shaft cavity 242. In various embodiments, the distance 284 between protrusions 258 is approximately 98.6% of the maximum diameter 248 of the shaft cavity 242. In some embodiments, the distance 284 between protrusions 258 is between approximately 98% and 99% of the maximum diameter 248 of the shaft cavity 242.

Figure 14B:
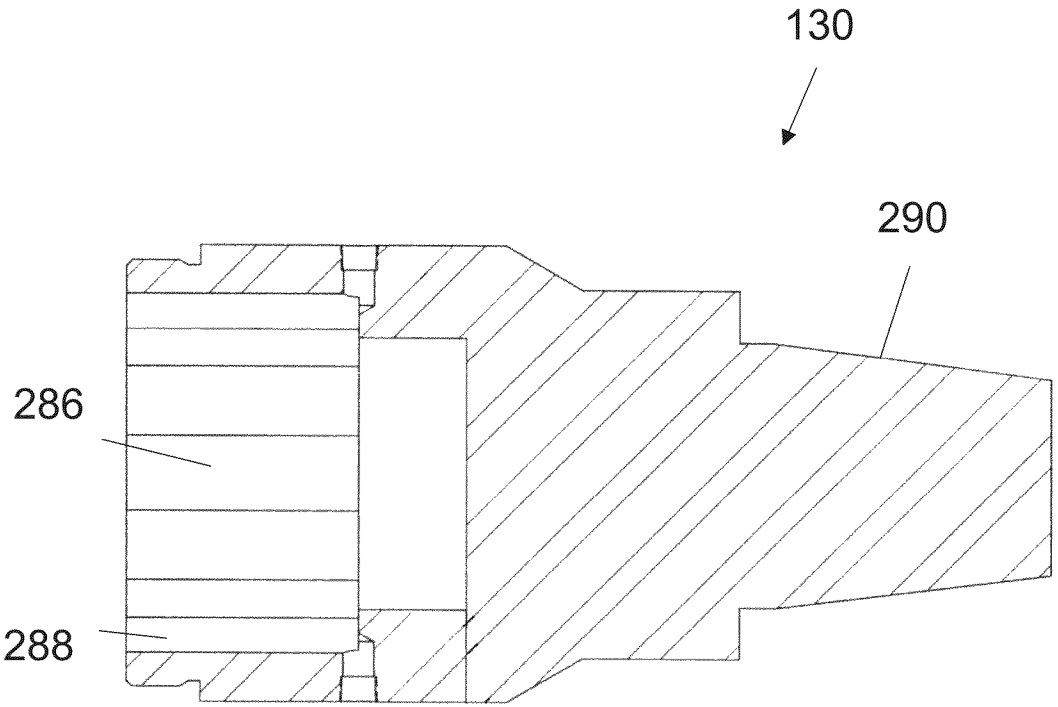
FIG. 14B is a cross-sectional view of the rotor adapter in FIG. 14A taken along line 14B-14B in accordance with an embodiment of the present disclosure.
Figure 14A:
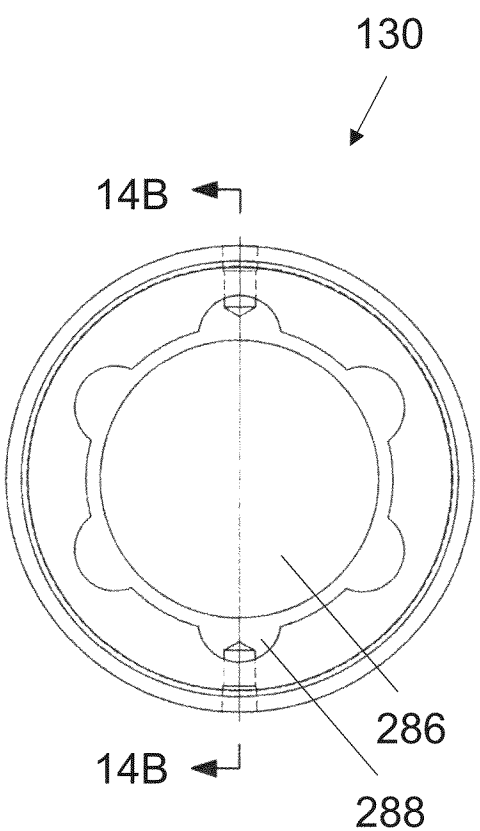
FIG. 14A is a front elevation view of a rotor adapter in accordance with an embodiment of the present disclosure.

FIGS. 14A and 14B show a front elevation view and a cross-sectional view, respectively, of a rotor adapter 130. The rotor adapter 130 is configured similarly to the bearing adapter. At a lower end, an inner surface of the rotor adapter 130 defines a shaft cavity 286 that includes a plurality of channels 288 configured to receive protrusions of the shaft. At an upper end, a threaded outer surface 290 connects the rotor adapter 130 to a rotor of a mud motor.

Figure 15B:
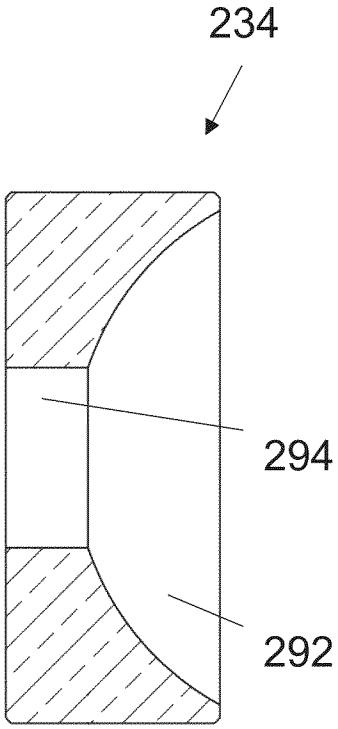
FIG. 15B is a cross-sectional view of the seat in FIG. 15A taken along line 15B-15B in accordance with an embodiment of the present disclosure.
Figure 15A:
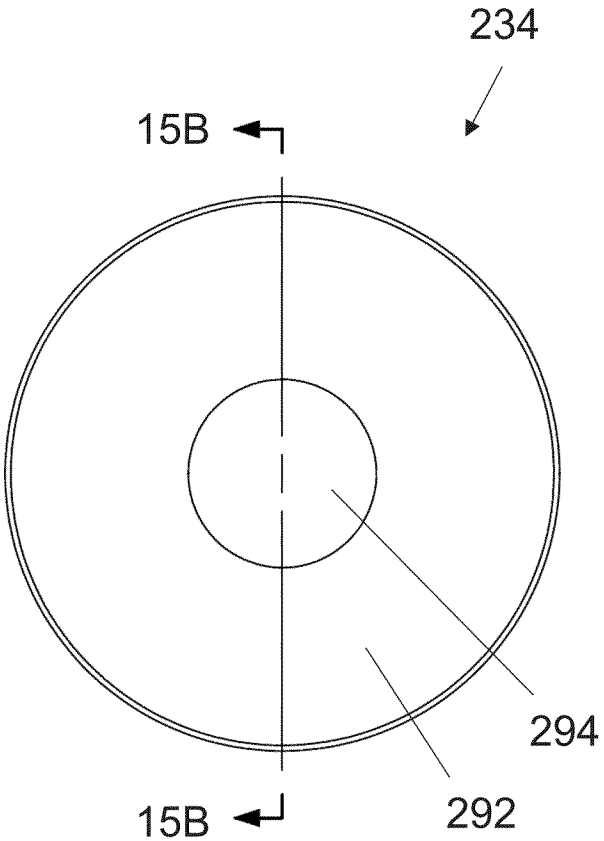
FIG. 15A is a front elevation view of a seat in accordance with an embodiment of the present disclosure.

FIGS. 15A and 15B show a front elevation view and a cross-sectional view, respectively, of a seat 234. The seat 234 generally comprises a seat cavity 292 with a concave shape that receives an end of the shaft. The seat 234 can be made from a material such as bronze to withstand wearing forces. A seat cap recess 294 extends through the seat 234 to house grease or another similar material that lubricates the connection between the seat 234 and the shaft.

Figure 16B:
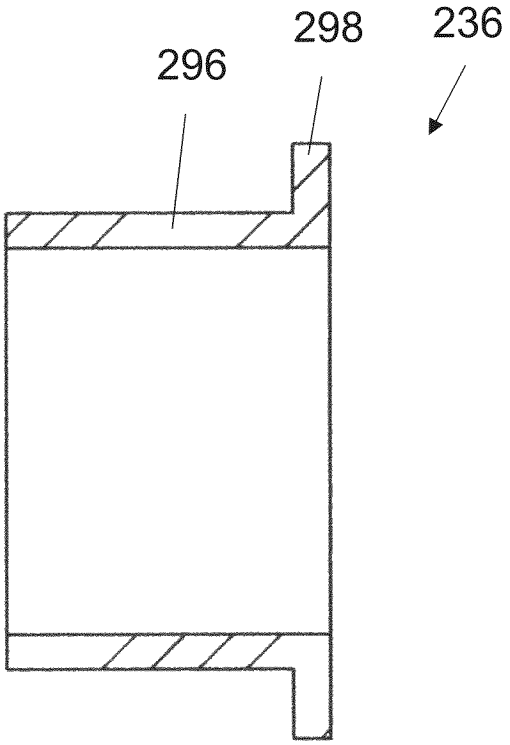
FIG. 16B is a cross-sectional view of the seal in FIG. 16A taken along line 16B-16B in accordance with an embodiment of the present disclosure.
Figure 16A:
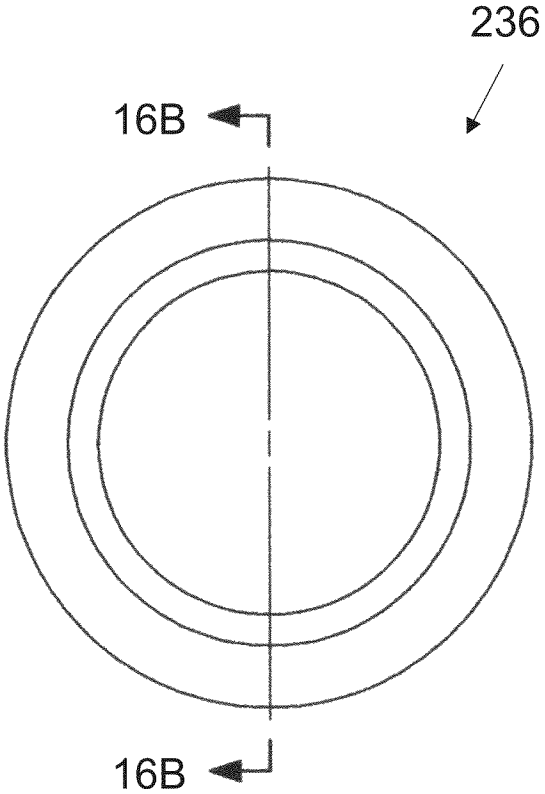
FIG. 16A is a front elevation view of a seal in accordance with an embodiment of the present disclosure.

FIGS. 16A and 16B show a front elevation view and a cross-sectional view, respectively, of a seal 236. The seal 236 generally has a shaft portion 296 and an end portion 298 joined at a right angle for a simple construction. The shaft portion 296 is positioned about the shaft 128, and the end portion 298 abuts an upper end of either the bearing adapter or the rotor adapter. The inner diameter established by the shaft portion 296 of the seal 236 is approximately 2.855+0.000/−0.005 inches (7.252+0.0000/−0.0127 cm) and the outer diameter of the shaft 128 is 2.875 inches (7.303 cm), a difference of at least 0.02 inches (0.0508 cm). Thus, the seal 236 is initially stretched to fit around the shaft 128 and provide a good seal against the shaft 128.

Figure 17B:
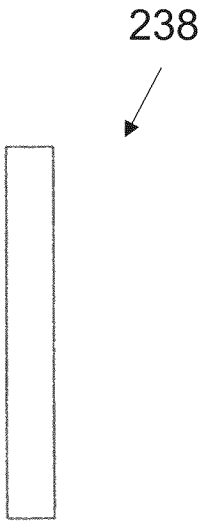
FIG. 17B is a side elevation view of the split ring in FIG. 17A in accordance with an embodiment of the present disclosure.
Figure 17A:
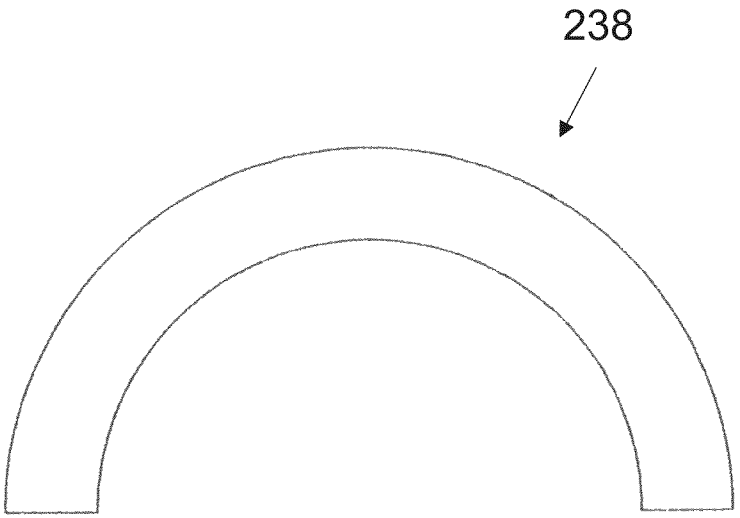
FIG. 17A is a front elevation view of a split ring in accordance with an embodiment of the present disclosure.

FIGS. 17A and 17B show a front elevation view and a side elevation view, respectively, of a split ring 238. The split ring is a more rigid and less pliable material compared to the seal 236. A set of two split rings 238 are positioned end to end to form a ring and are positioned between a seal and bonnet at the bearing adapter, and another set of two split rings 238 are positioned end to end to form a ring and are positioned between a seal and a bonnet at the rotor adapter.

Figure 18A:
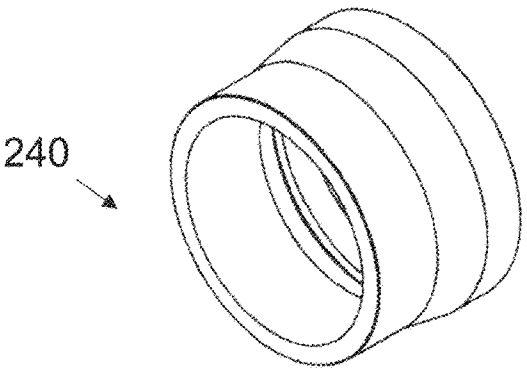
FIG. 18A is a perspective view of a bonnet in accordance with an embodiment of the present disclosure.
Figure 18B:
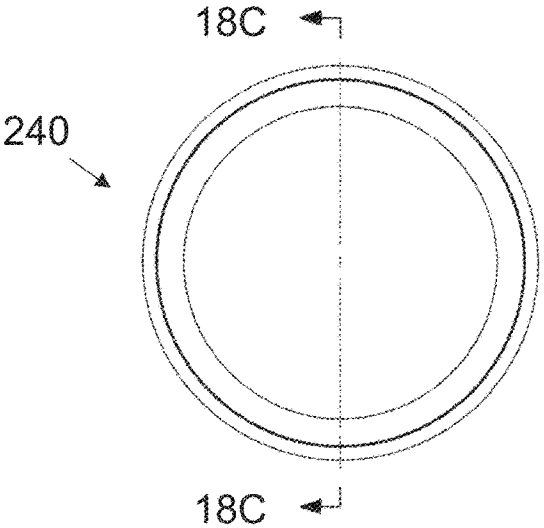
FIG. 18B is a front elevation view of the bonnet in FIG. 18A in accordance with an embodiment of the present disclosure.
Figure 18C:
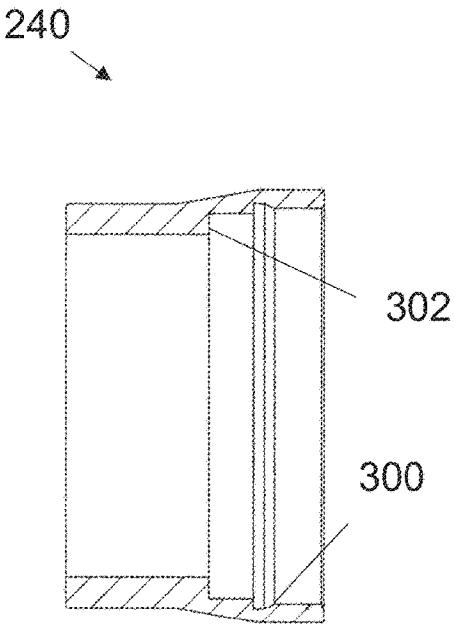
FIG. 18C is a cross-sectional view of the bonnet in FIG. 18B taken along line 18C-18C in accordance with an embodiment of the present disclosure.

FIGS. 18A-18C show a perspective view, a front elevation view, and a cross-sectional view, respectively, of a bonnet 240. The bonnet 240 holds the seals in place at either the bearing adapter or the rotor adapter. Specifically, a threaded inner surface 300 joins the bonnet 240 to one of the adapters, and a shoulder 302 holds the seals in place.

FIGS. 19-34B show dimensions for various components of an embodiment of the downhole assembly. The dimensions for each figure are outlined in the tables below. It will be appreciated that these dimensions are only exemplary in nature, and the present disclosure encompasses embodiments with other dimensions than those shown and described.

TABLE 1

Dimensions of a mandrel 108 shown in FIG. 19.

| Ref. No. | Description | Dimension | Dimension (SI) |
|---|---|---|---|
| 304 | Overall Length | 48.65" | 123.57 cm |
| 306 | Outer Diameter at Lower Portion | 7.0" | 17.8 cm |
| 308 | Width at Lower End | 5.0" | 12.7 cm |
| 310 | Inner Threaded Surface | 4½" (4.5") Regular Thread | 11.4 cm |
| 312 | Length to Recess | 7.0" | 17.8 cm |
| 314 | Recess Width | 1.0" | 2.5 cm |
| 316 | Outer Diameter at Recess | 6.815" | 17.31 cm |
| 318 | Length to Lower Portion | 38.71" | 98.32 cm |
| 320 | Taper Angle | 60 degrees | — |
| 322 | Curve Radius | 0.5" | 1.27 cm |
| 324 | Length to Flat | 37.844" | 96.124 cm |
| 326 | Length to Shoulder | 37.694" | 95.743 cm |
| 328 | Diameter at Shoulder | 5.0" | 12.7 cm |
| 330 | Curve Radius | 0.09" | 0.229 cm |
| 332 | Outer Diameter at Middle Portion | 4.185" +0.000" −0.005" | 10.6299 cm +0.000 cm −0.0127 cm |
| 334 | Length to Notch | 28.027" | 71.189 cm |
| 336 | Taper Angle | 60 degrees | — |
| 338 | Curve Radius | 0.2" | 0.51 cm |
| 340 | Thread Characteristics | Major 4.14" Minor 3.822" LH DIN 405 | Major 10.516 cm Minor 9.708 cm |
| 342 | Thread Length | 1.88" | 4.78 cm |
| 344 | Length to Thread | 25.709" | 65.301 cm |
| 346 | Outer Diameter at Upper Portion | 3.675" +/−0.001" | 9.335 cm +/−0.00254 cm |
| 348 | Inner Diameter | 1.75" | 4.45 cm |
| 350 | Length to Recess | 5.928" | 15.057 cm |
| 352 | Taper Angle | 15 degrees | — |
| 354 | Curve Radius | 0.25" | 0.635 cm |
| 356 | Outer Diameter at Radius | 3.375" | 8.573 cm |
| 358 | Thread Characteristics | Major 3.668" 3.680" Minor3.400" 3.428" 3.7" DIN 405 | Major 9.317 cm 9.347 cm Minor 8.636 cm 8.707 cm 9.4 cm DIN 405 |
| 360 | Taper Angle | 10 degrees | — |
| 362 | Diameter at Upper Opening | 2.0" | 5.08 cm |
| 364 | Chamfer | 0.26" × 30 degrees | 0.66 cm × 30 degrees |

TABLE 2

Figure 20:
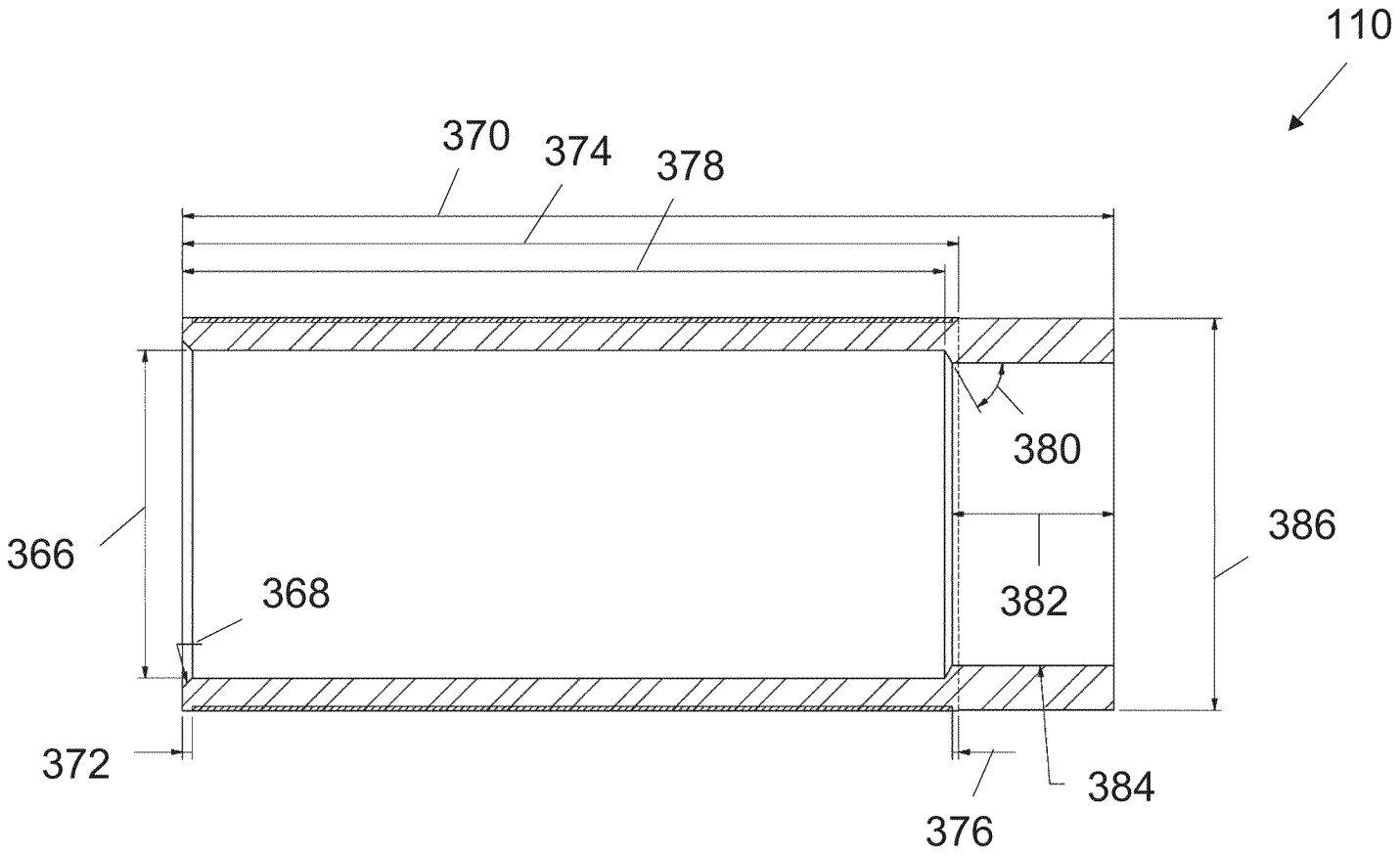
FIG. 20 is a cross-sectional view of a lower male portion of a lower radial bearing in accordance with an embodiment of the present disclosure.

Dimensions of a lower male portion 110 shown in FIG. 20.

| Ref. No. | Description | Dimension | Dimension (SI) |
|---|---|---|---|
| 366 | Diameter at Lower Opening | 5.04" | 12.8 cm |
| 368 | Chamfer | 0.125" × 45 degrees | 0.318 cm × 45 degrees |
| 370 | Overall Length | 12.0" | 30.48 cm |
| 372 | Enhanced Surface Offset | 0.125" | 0.3175 cm |
| 374 | Length to Datum | 10.0" | 25.4 cm |
| 376 | Enhanced Surface to Datum | 0.083" | 0.2108 cm |
| 378 | Length to Taper | 9.822" | 24.948 cm |
| 380 | Taper Angle | 60 degrees | — |
| 382 | Length to Upper End | 2.984" | 7.579 cm |
| 384 | Thread Characteristics | Major 4.14" Minor 3.872" LH DIN 405 | Major 10.515 cm Minor 9.835 cm |

TABLE 2-continued

Dimensions of a lower male portion 110 shown in FIG. 20.

| Ref. No. | Description | Dimension | Dimension (SI) |
|---|---|---|---|
| 386 | Outer Diameter at Upper Opening | 5.018" | 12.746 cm |

TABLE 3

Figure 21:
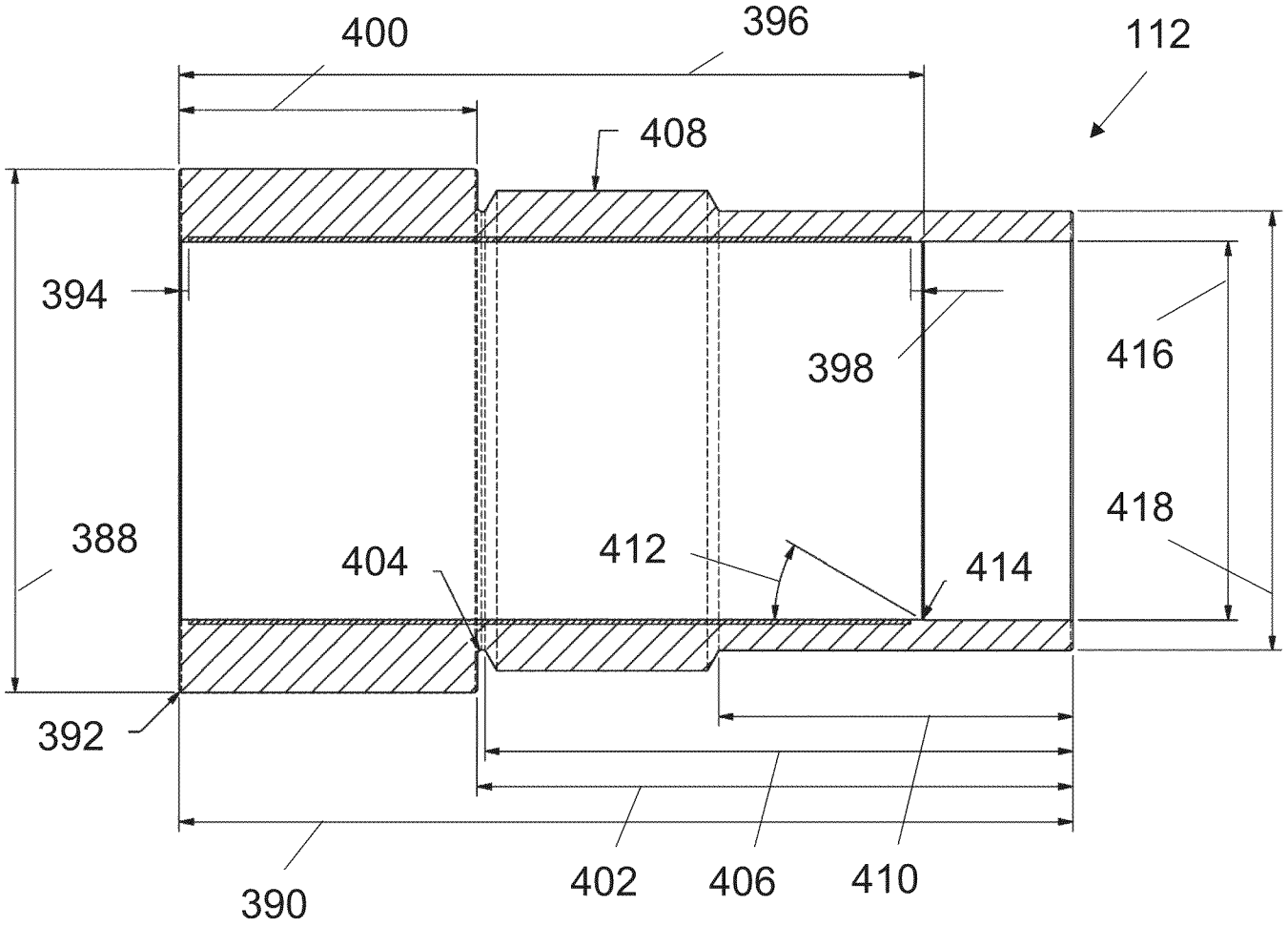
FIG. 21 is a cross-sectional view of a lower female portion of a lower radial bearing in accordance with an embodiment of the present disclosure.

Dimensions of a lower female portion 112 shown in FIG. 21.

| Ref. No. | Description | Dimension | Dimension (SI) |
|---|---|---|---|
| 388 | Overall Diameter | 7.0" | 17.78 cm |
| 390 | Overall Length | 12.0" | 30.48 cm |
| 392 | Chamfer | 0.03" × 45 degrees | 0.0762 cm × 45 degrees |
| 394 | Enhanced Surface Offset | 0.125" | 0.3175 cm |
| 396 | Length to Recess | 10.0" | 25.4 cm |
| 398 | Enhanced Surface to Recess | 0.149" | 0.378 cm |
| 400 | Length of Lower Portion | 4.0" | 10.16 cm |
| 402 | Length to Lower Portion | 8.0" | 20.32 cm |
| 404 | Curve Radius | 0.06" | 0.1524 cm |
| 406 | Length to Radius/Thread | 7.896" | 20.0558 cm |
| 408 | Thread Characteristics | 6.42" LH Stub ACME 4P | 16.31 cm LH Stub ACME 4P |
| 410 | Length to Thread | 4.754" | 12.0752 cm |
| 412 | Taper Angle | 30 degrees | — |
| 414 | Curve Radius | 0.05" | 0.127 cm |
| 416 | Inner Diameter | 5.064" | 12.8625 cm |
| 418 | Outer Diameter at Upper End | 5.874" | 14.9199 cm |

TABLE 4

Figure 22:
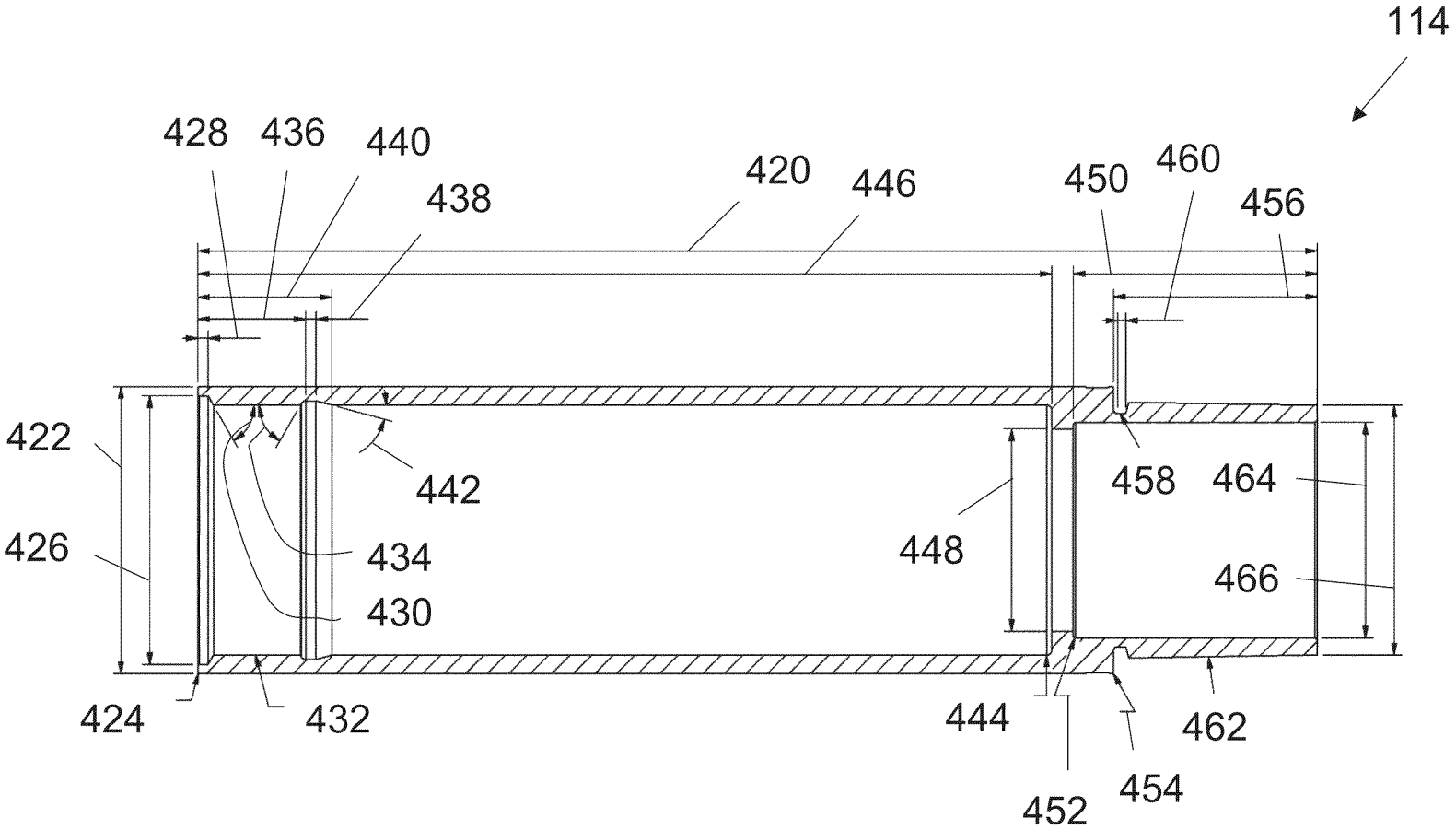
FIG. 22 is a cross-sectional view of a bearing housing in accordance with an embodiment of the present disclosure.

Dimensions of a bearing housing 114 shown in FIG. 22.

| Ref. No. | Description | Dimension | Dimension (SI) |
|---|---|---|---|
| 420 | Overall Length | 27.516" | 69.891 cm |
| 422 | Overall Outer Diameter | 7.0" | 17.78 cm |
| 424 | Chamfer | 0.03" × 45 degrees | 0.0762 cm × 45 degrees |
| 426 | Diameter at Lower End | 6.55" | 16.64 cm |
| 428 | Flat Portion Length | 0.25" | 0.635 cm |
| 430 | Taper Angle | 60 degrees | — |
| 432 | Thread Characteristics | 6.42" LH Stub ACME | 16.31 cm LH Stub ACME |
| 434 | Taper Angle | 60 degrees | — |
| 436 | Length to Upper End of Thread | 2.649" | 6.7285 cm |
| 438 | Flat Portion Length | 0.255" | 0.6477 cm |
| 440 | Length to End of Taper | 3.292" | 8.362 cm |
| 442 | Taper Angle | 15 degrees | — |
| 444 | Curve Radius | 0.125" | 0.3175 cm |
| 446 | Length to Shoulder | 20.987" | 53.3070 cm |
| 448 | Inner Diameter at Shoulder | 4.935" | 12.5349 cm |
| 450 | Length to Upper End of Shoulder | 6.0" | 15.24 cm |
| 452 | Curve Radius | 0.06" | 0.1524 cm |
| 454 | Chamfer | 0.03" × 45 degrees | 0.0762 cm × 45 degrees |
| 456 | Length to Outer Shoulder | 5.01" | 12.725 cm |
| 458 | Curve Radius | 0.1" | 0.254 cm |
| 460 | Flat Portion Length | 0.2" | 0.508 cm |
| 462 | Thread Characteristics | 6.25" Stub ACME Modified 0.375" TPF | 15.785 cm Stub ACME Modified 0.9525 cm TPF |
| 464 | Diameter at Upper End | 5.254" +0.001" −0.000" | 13.345 cm +0.00254 cm −0.000 cm |
| 466 | Outer Diameter at Upper End | 6.09" | 15.47 cm |

TABLE 5

Figure 23B:
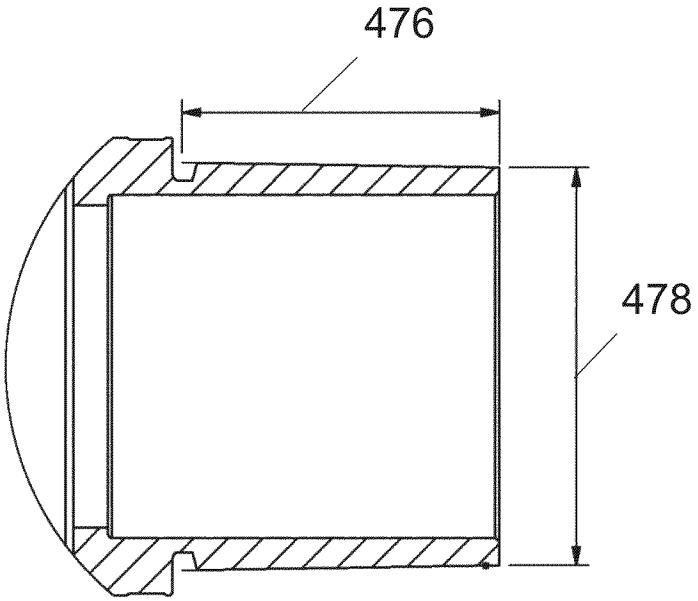
FIG. 23B is a cross-sectional view of a pin blank in accordance with an embodiment of the present disclosure.
Figure 23A:
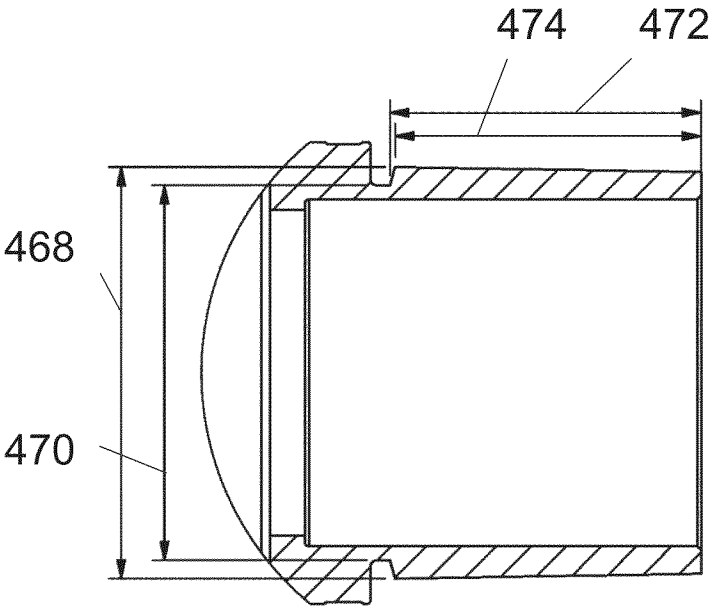
FIG. 23A is a cross-sectional view of a pin blank in accordance with an embodiment of the present disclosure.

Dimensions of a pin blank of the bearing housing 114 shown in FIGS. 23A and 23B.

| Ref. No. | Description | Dimension | Dimension (SI) |
|---|---|---|---|
| 468 | Outer Diameter at Lower End of Thread | 6.235" | 15.837 cm |
| 470 | Diameter at Flat Portion | 5.684" | 14.437 cm |
| 472 | Length to Flat Portion | 4.71" | 11.96 cm |
| 474 | Thread Length | 4.635" | 11.773 cm |
| 476 | Thread Dimension (Length) | 4.866" | 12.360 cm |
| 478 | Thread Dimension (Diameter) | 6.09" | 15.469 cm |

TABLE 6

Figure 24:
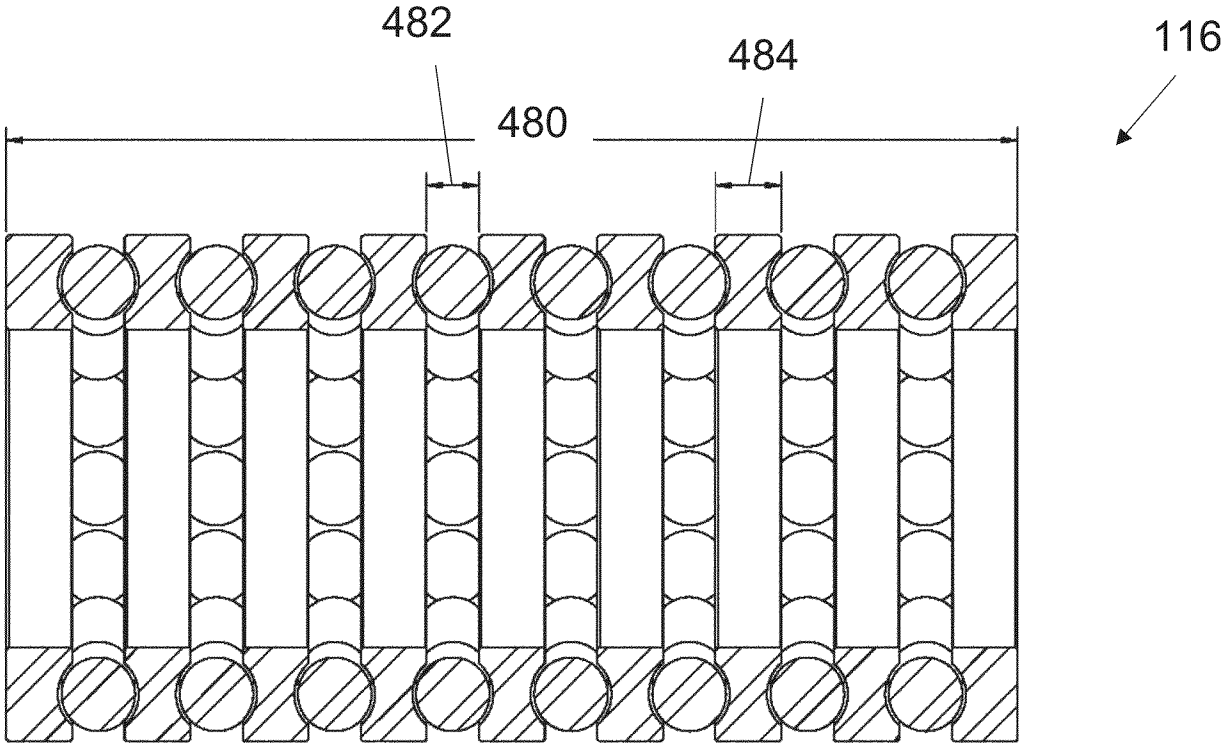
FIG. 24 is a cross-sectional view of a thrust bearing in accordance with an embodiment of the present disclosure.

Dimensions of a thrust bearing 116 shown in FIG. 24.

| Ref. No. | Description | Dimension | Dimension (SI) |
|---|---|---|---|
| 480 | Overall Length | 12.0" | 30.48 cm |
| 482 | Race Spacing | 0.622" | 1.580 cm |
| | | +0.000" | +0.000 cm |
| | | −0.060" | −0.152 cm |
| 484 | Race Length | 0.780" | 1.981 cm |
| | | +0.000" | +0.000 cm |
| | | −0.020" | −0.051 cm |

TABLE 7

Figure 25B:
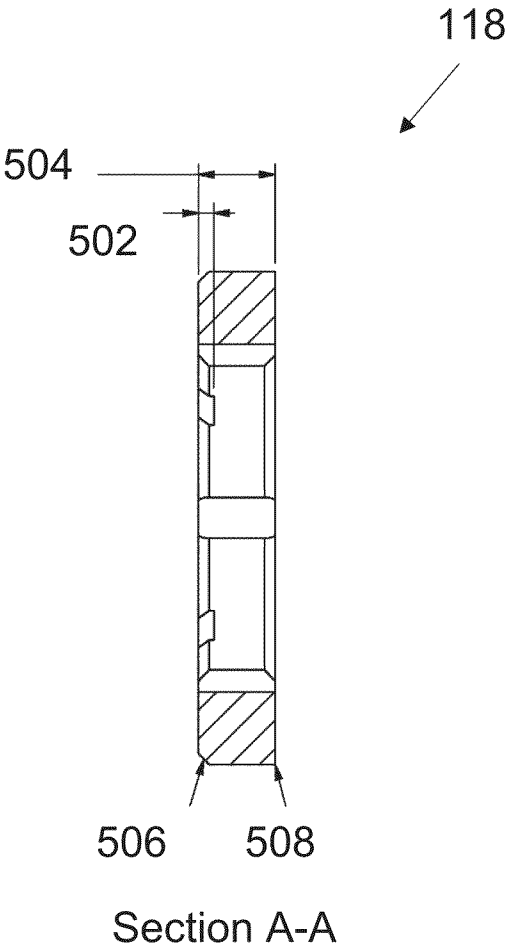
FIG. 25B is a cross-sectional view of a thrust ring in accordance with an embodiment of the present disclosure.
Figure 25A:
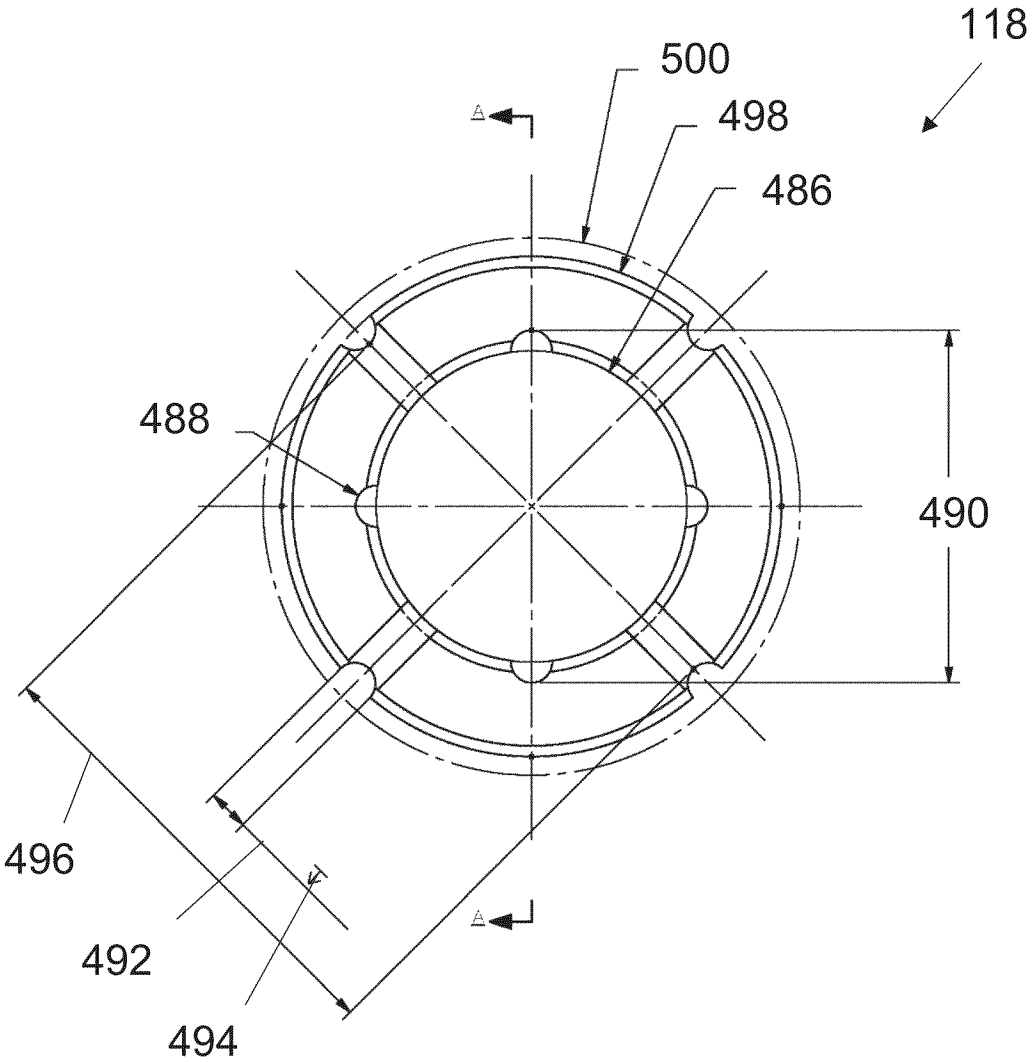
FIG. 25A is an elevation view of a thrust ring in accordance with an embodiment of the present disclosure.

Dimensions of a thrust ring 118 shown in FIGS. 25A and 25B.

| Ref. No. | Description | Dimension | Dimension (SI) |
|---|---|---|---|
| 486 | Inner Diameter | 3.755" | 9.538 cm |
| | | 3.753" | 9.533 cm |
| 488 | Inner Notch Diameter | 0.5" | 1.27 cm |
| 490 | Diameter End of Inner Notch to End of Inner Notch | 4.255" | 10.808 cm |
| 492 | Outer Notch Diameter | 0.5" | 1.27 cm |
| 494 | Notch Offset | 0.188" | 0.478 cm |
| 496 | Diameter End of Outer Notch to End of Outer Notch | 5.54" | 14.07 cm |
| 498 | Outer Diameter | 6.043" | 15.349 cm |
| | | 6.040" | 15.342 cm |
| 500 | Diameter at Outer Notch Centers | 6.49" | 16.48 cm |
| 502 | Outer Notch Length | 0.188" | 0.478 cm |
| 504 | Overall Length | 0.937" +/− 0.002" | 2.380 cm +/− 0.0051 cm |
| 506 | Chamfer | 0.13" × 45 degrees | 0.33 cm × 45 degrees |
| 508 | Edge Break | — | — |

TABLE 8

Figure 26B:
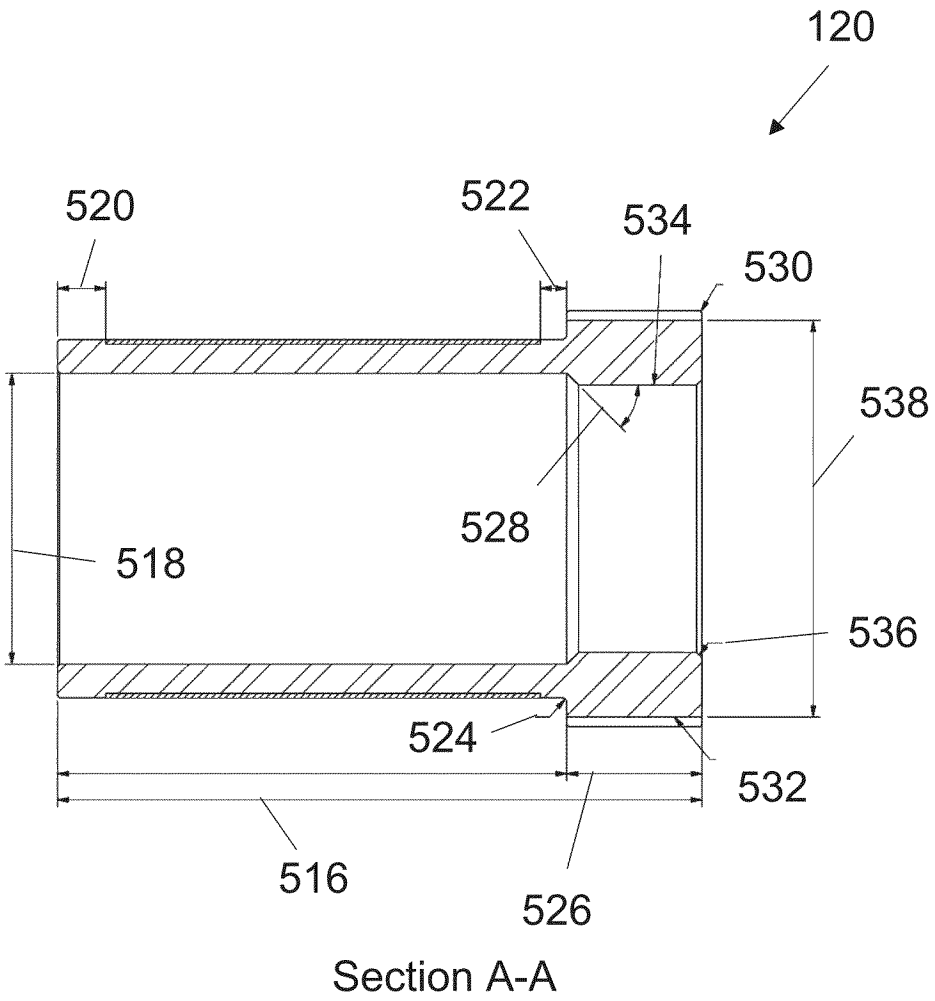
FIG. 26B is a cross-sectional view of an upper male portion of an upper radial bearing in accordance with an embodiment of the present disclosure.
Figure 26A:
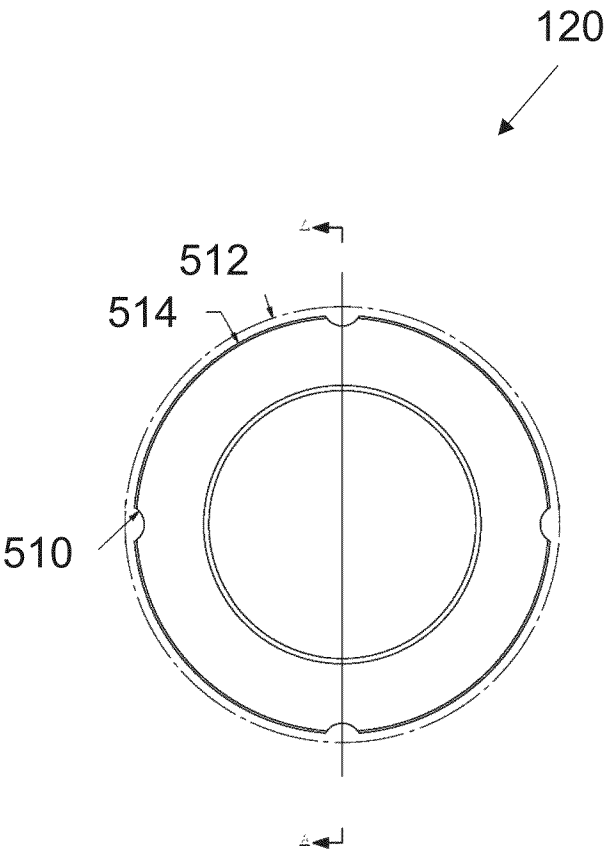
FIG. 26A is an elevation view of an upper male portion of an upper radial bearing in accordance with an embodiment of the present disclosure.

Dimensions of an upper male portion 120 shown in FIGS. 26A and 26B.

| Ref. No. | Description | Dimension | Dimension (SI) |
|---|---|---|---|
| 510 | Outer Notch Radius | 0.25" | 0.635 cm |
| 512 | Outer Diameter | 5.4" | 13.72 cm |
| 514 | Diameter at Outer Notch Centers | 5.625" | 14.288 cm |
| 516 | Overall Length | 8.356" | 21.224 cm |
| 518 | Inner Diameter | 3.76" | 9.55 cm |
| | | +0.001" | +0.0025 cm |
| | | −0.000" | −0.0000 cm |
| 520 | Enhanced Surface Offset | 0.63" | 1.60 cm |
| 522 | Length between Enhanced Surface and Shoulder | 0.344" | 0.873 cm |
| 524 | Curve Radius | 0.06" | 0.152 cm |

TABLE 8-continued

Dimensions of an upper male portion 120 shown in FIGS. 26A and 26B.

| Ref. No. | Description | Dimension | Dimension (SI) |
|---|---|---|---|
| 526 | Shoulder Length | 1.752" | 4.450 cm |
| 528 | Taper Angle | 45 degrees | — |
| 530 | Chamfer | 0.03" × 45 degrees | 0.0762 cm × 45 degrees |
| 532 | Grooves | — | — |
| 534 | Thread Characteristics | 3.7" | 9.40 cm |
| | | Major | Major |
| | | 3.708" | 9.418 cm |
| | | 3.738" | 9.494 cm |
| | | Minor | Minor |
| | | 3.480" | 8.839 cm |
| | | 3.485" | 8.852 cm |
| | | DIN 405 | |
| 536 | Chamfer | 0.068" × 45 degrees | 0.173 cm × 45 degrees |
| 538 | Diameter at Grooves | 5.125" | 13.018 cm |

TABLE 9

Figure 27:
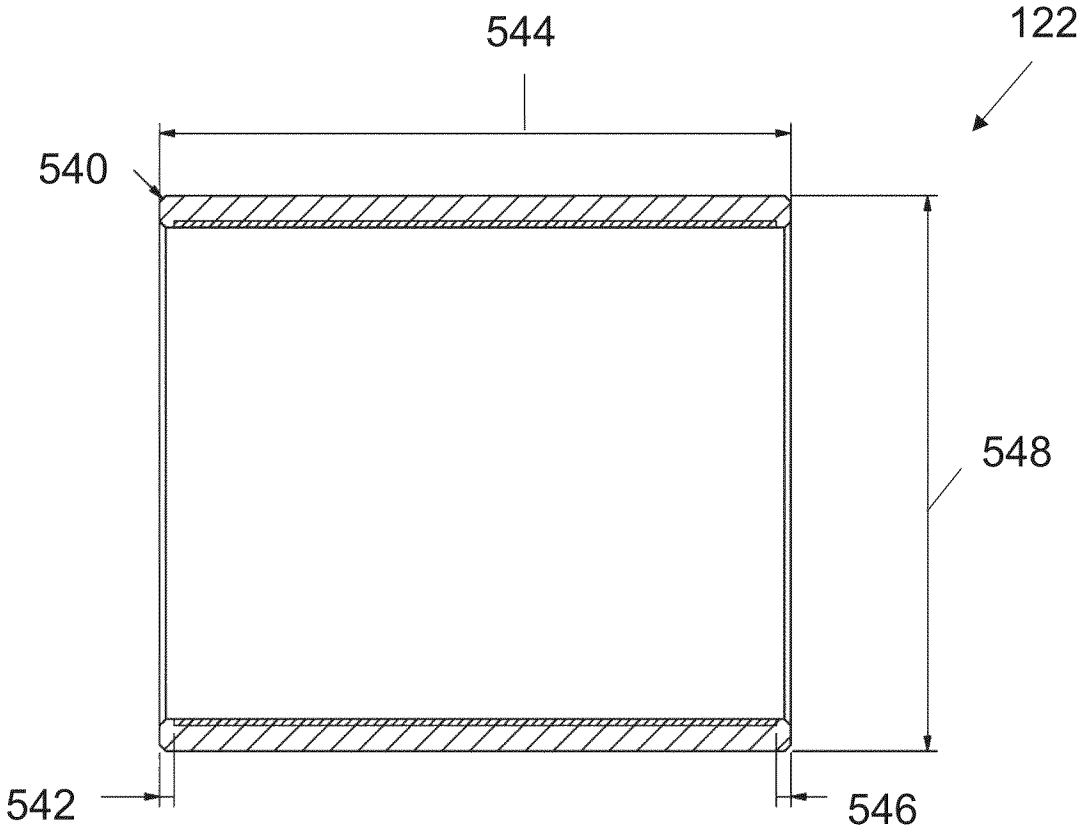
FIG. 27 is a cross-sectional view of an upper female portion of an upper radial bearing in accordance with an embodiment of the present disclosure.

Dimensions of an upper female portion 122 shown in FIG. 27.

| Ref. No. | Description | Dimension | Dimension (SI) |
|---|---|---|---|
| 540 | Chamfer | 0.06" × 45 degrees | 0.1524 cm × 45 degrees |
| 542 | Enhanced Surface Offset | 0.138" | 0.351 cm |
| 544 | Overall Length | 6.0" +/− 0.002" | 15.24 cm +/− 0.0051 cm |
| 546 | Enhanced Surface Offset | 0.138" | 0.351 cm |
| 548 | Overall Diameter | 5.249" +/− 0.001" | 13.332 cm +/− 0.00254 cm |

TABLE 9

Figure 28:
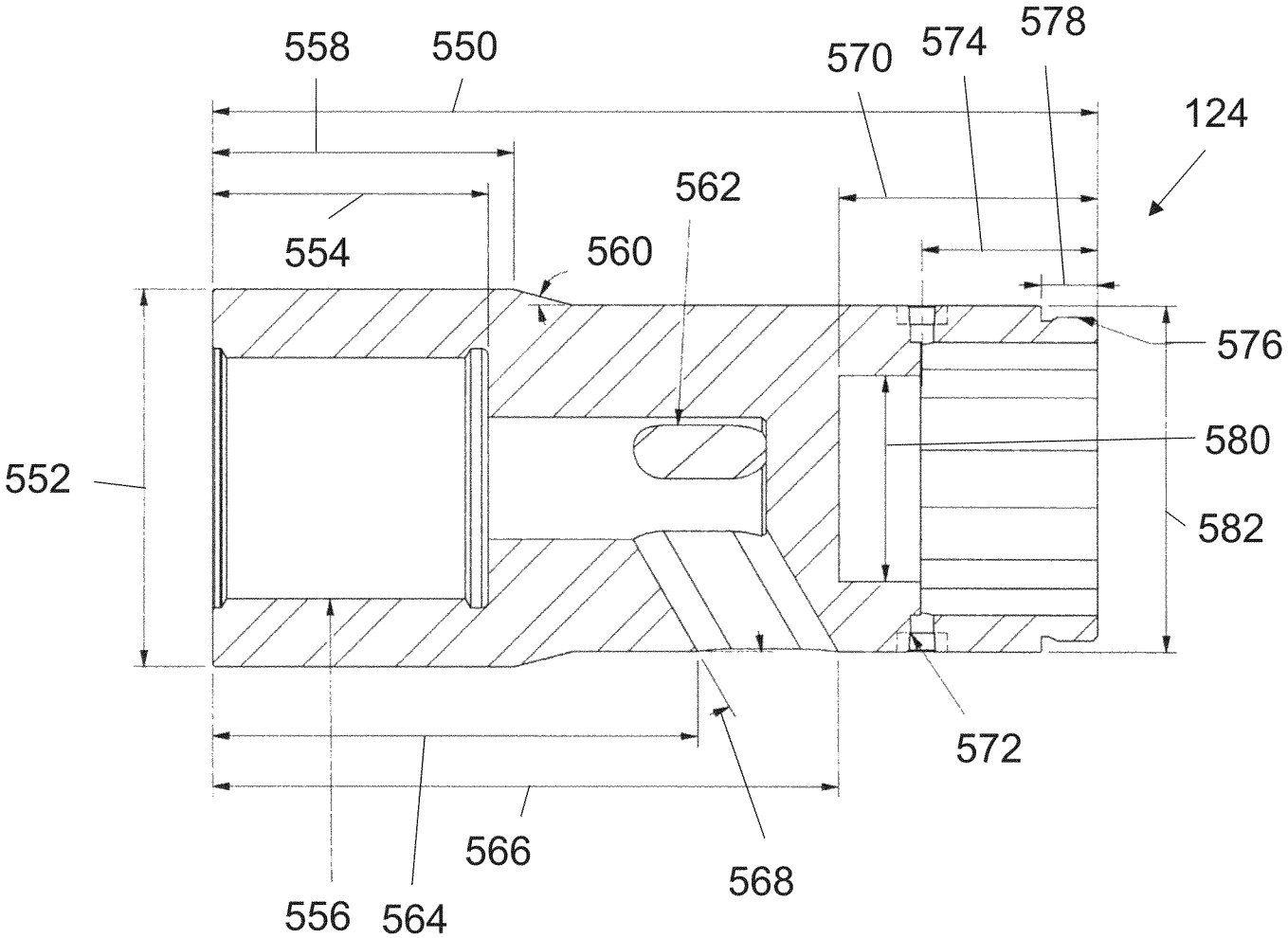
FIG. 28 is a cross-sectional view of a bearing adapter in accordance with an embodiment of the present disclosure.

Dimensions of a bearing adapter 124 shown in FIG. 28.

| Ref. No. | Description | Dimension | Dimension (SI) |
|---|---|---|---|
| 550 | Overall Length | 12.62" | 32.05 cm |
| 552 | Outer Diameter | 5.4" | 13.72 cm |
| 554 | Enclosed Volume Length | 3.932" | 9.987 cm |
| 556 | Thread Characteristics | 3.7" 4P DIN 405 Major 3.708"/ 3.738" Minor 3.48"/ 3.485" | 9.40 cm Major 9.418 cm/ 9.495 cm Minor 8.839 cm/ 8.852 cm |
| 558 | Length to Taper | 4.3" | 10.9 cm |
| 560 | Taper Angle | 15 degrees | — |
| 562 | Slot Dimension (Three Slots × 120 Degrees Apart) | 2" × 0.875" | 5.08 cm × 2.223 cm |
| 564 | First Length to Slot | 6.92" | 17.58 cm |
| 566 | Second Length to Slot | 8.92" | 20.32 cm |
| 568 | Taper Angle | 60 degrees | — |
| 570 | Length to Seat Recess | 3.687" | 9.365 cm |
| 572 | Thread Characteristics (Two Holes × 180 Degrees Apart) | 0.332" Through ⅛" NPT | 0.843 cm 0.3175 cm NPT |
| 574 | Length to Thread Center | 2.52" | 6.40 cm |
| 576 | Thread Characteristics | 4.625" 8P Stub ACME | 11.748 cm |
| 578 | Length to Shoulder | 0.8" | 1.03 cm |
| 580 | Seat Recess Diameter | 2.95" +/− 0.002" | 7.49 cm +/− 0.0051 cm |
| 582 | Diameter at Upper End | 4.95" | 12.57 cm |

TABLE 10

Figure 29:
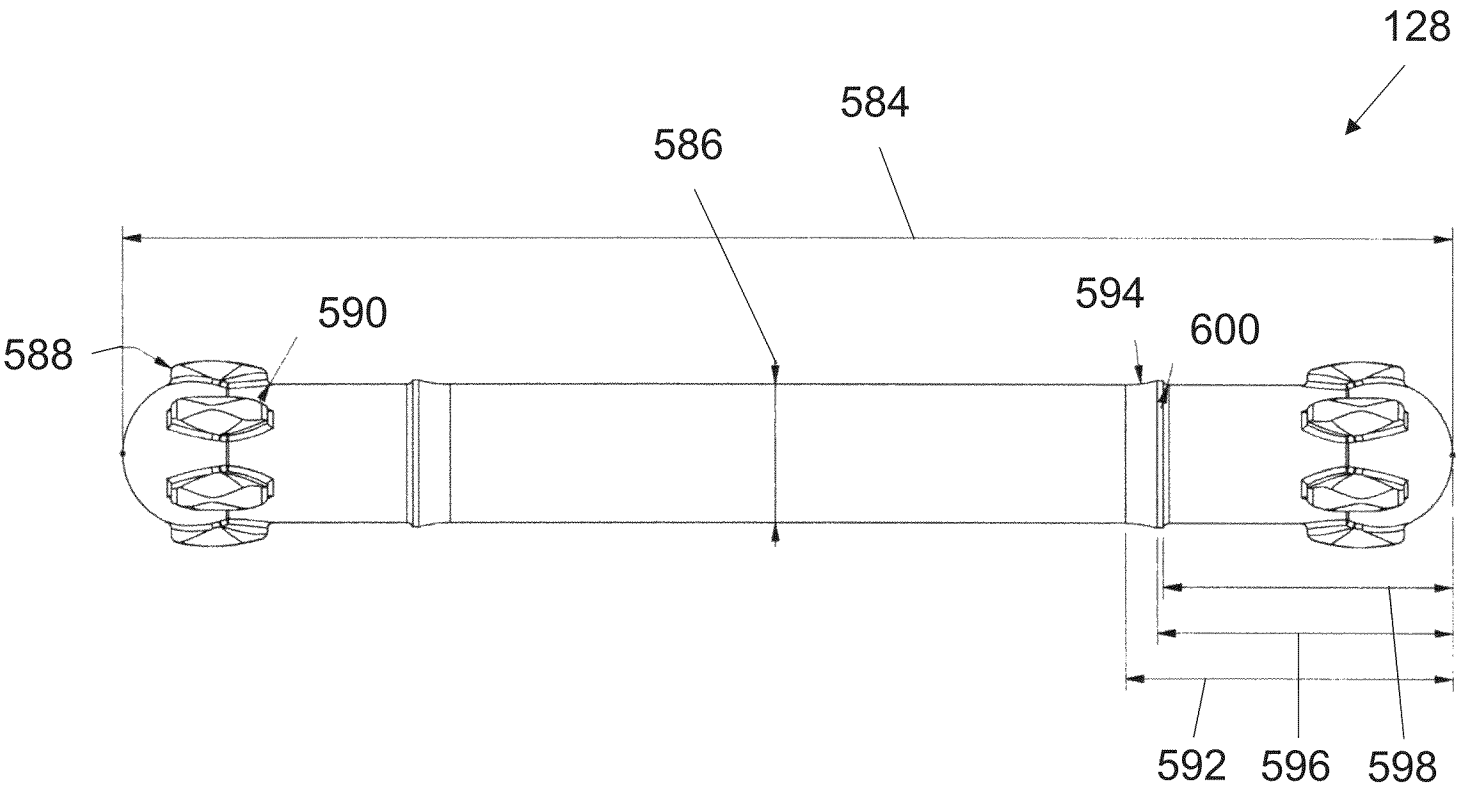
FIG. 29 is an elevation view of a shaft in accordance with an embodiment of the present disclosure.

Dimensions of a shaft 128 shown in FIG. 29.

| Ref. No. | Description | Dimension | Dimension (SI) |
|---|---|---|---|
| 584 | Overall Length | 27.558" | 69.997 cm |
| 586 | Outer Diameter at Center | 2.875" | 7.303 cm |
| 588 | Curve Radius | 0.16" | 0.406 cm |
| 590 | Curve Radius | 0.15" | 0.381 cm |
| 592 | Length to Collar | 6.781" | 17.224 cm |
| 594 | Curve Radius | 2.5" | 6.35 cm |
| 596 | Length to Lower End of Flat Portion | 6.125" | 15.558 cm |
| 598 | Length to Upper End of Flat Portion | 6.0" | 15.24 cm |
| 600 | Radius | 0.125" | 0.3175 cm |

TABLE 11

Figure 30B:
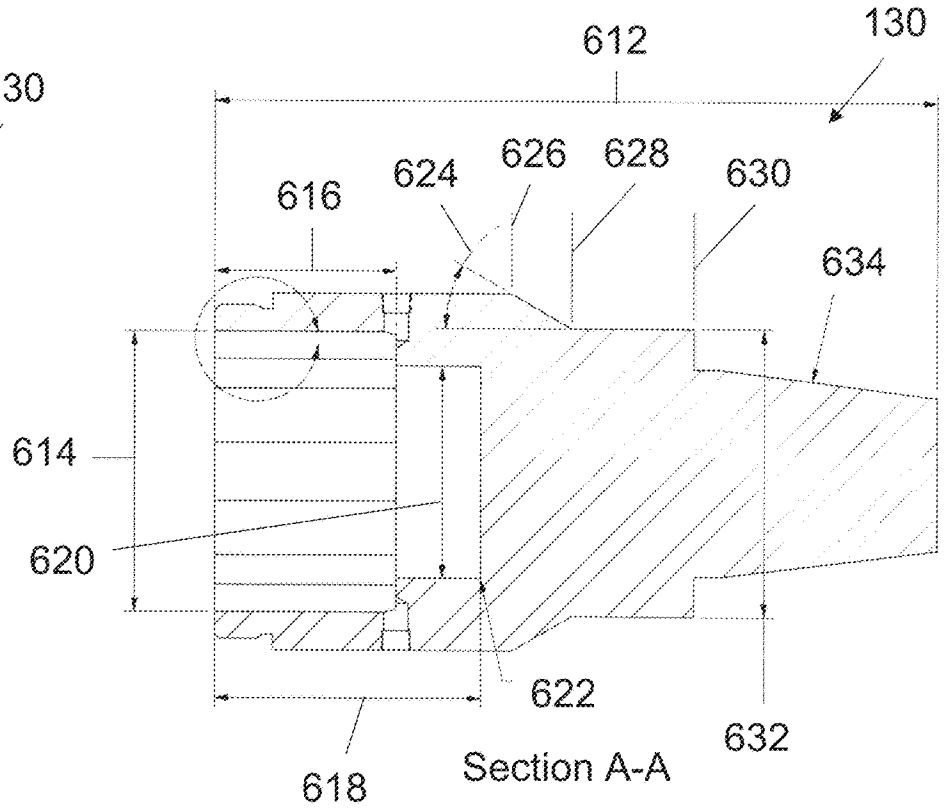
FIG. 30B is a cross-sectional view of a rotor adapter in accordance with an embodiment of the present disclosure.
Figure 30A:
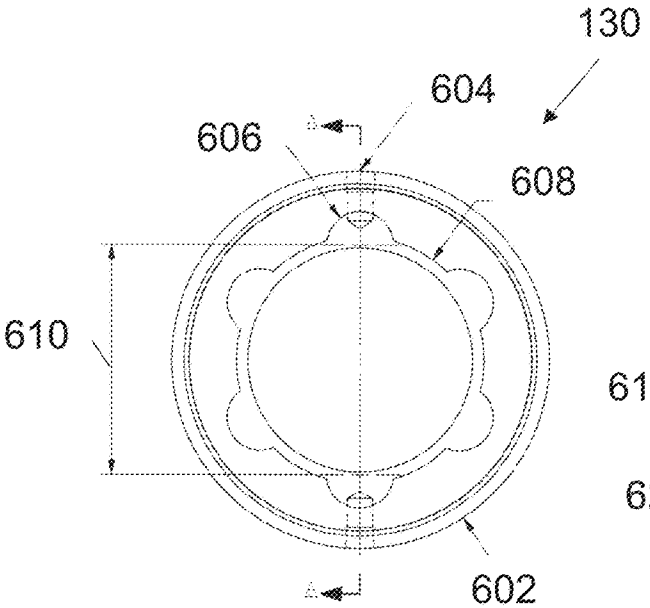
FIG. 30A is an elevation view of a rotor adapter in accordance with an embodiment of the present disclosure.
Figure 30C:
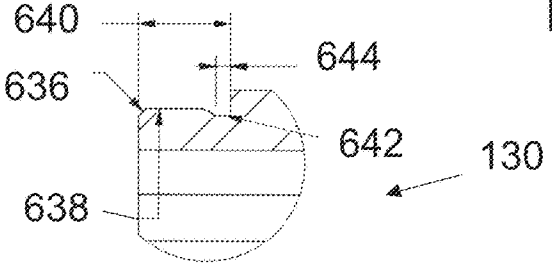
FIG. 30C is a detailed view of a rotor adapter in accordance with an embodiment of the present disclosure.

Dimensions of a rotor adapter 130 shown in FIGS. 30A-30C.

| Ref. No. | Description | Dimension | Dimension (SI) |
|---|---|---|---|
| 602 | Outer Diameter | 4.95" | 12.573 cm |
| 604 | Thread Characteristics (Two Holes × 180 Degrees Apart) | ⅛" NPT Tapped Hole | 0.3175 cm |
| 606 | Channel Diameter | 0.875" | 2.223 cm |
| 608 | Inner Diameter | 3.2" +0.010" −0.005" | 8.3 cm + 0.0254 cm −0.0127 cm |
| 610 | Distance between Channel Centers | 3.025" | 7.6835 cm |
| 612 | Overall Length | 10.018" | 25.446 cm |
| 614 | Distance Between Channel Ends | 3.9" +0.005" −0.000" | 9.9 cm +0.0127 cm −0.0000 cm |
| 616 | Channel Length | 2.52" | 6.40 cm |
| 618 | Length to Distal End of Seat Recess | 3.687" | 9.365 cm |
| 620 | Seat Recess Diameter | 2.95" +/− 0.002" | 7.493 cm +/− 0.0051 cm |
| 622 | Curve Radius | 0.05" Maximum | 0.127 cm Maximum |
| 624 | Taper Angle | 30 degrees | — |
| 626 | Length to Lower End of Taper | 4.119" | 10.462 cm |
| 628 | Length to Upper End of Taper | 4.942" | 12.553 cm |
| 630 | Length to Shoulder | 6.643" | 16.873 cm |
| 632 | Diameter at Shoulder | 4.0" | 10.16 cm |
| 634 | Thread Characteristics | 2-⅞" Reg | 7.303 cm Reg |
| 636 | Chamfer | 0.07" × 45 degrees | 0.178 cm × 45 degrees |
| 638 | Thread Characteristics | 4.625" 8P Stub ACME RH Major 4.625" +0.000" −0.005" | 11.748 cm 8P Stub ACME RH Major 11.748 cm +0.000 cm −0.0127 cm |
| 640 | Length to Shoulder | 0.8" | 2.032 cm |
| 642 | Length of Flat Portion | 0.125" | 0.3175 cm |
| 644 | Diameter at Flat Portion | 4.51" | 11.46 cm |

TABLE 12

Figure 31B:
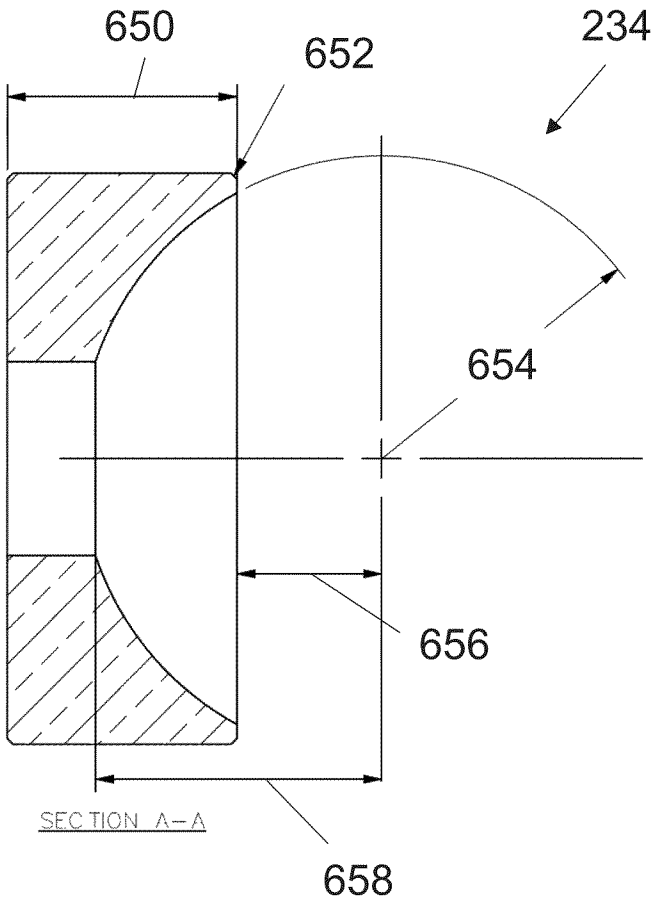
FIG. 31B is a cross-sectional view of a seat in accordance with an embodiment of the present disclosure.
Figure 31A:
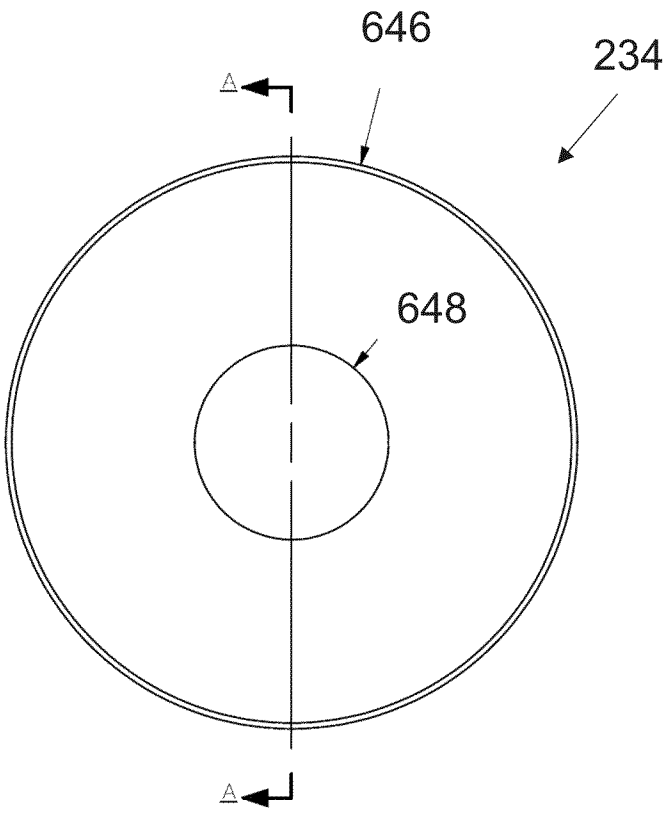
FIG. 31A is an elevation view of a seat in accordance with an embodiment of the present disclosure.

Dimensions of a seat 234 shown in FIGS. 31A and 31B.

| Ref. No. | Description | Dimension | Dimension (SI) |
|---|---|---|---|
| 646 | Outer Diameter | 2.947" +/− 0.001" | 7.485 cm +/− 0.00254 cm |
| 648 | Inner Diameter | 1.0" | 2.54 cm |
| 650 | Overall Length | 1.188" +0.005" −0.000" | 3.018 cm +0.0127 cm −0.0000 cm |

TABLE 12-continued

Dimensions of a seat 234 shown in FIGS. 31A and 31B.

| Ref. No. | Description | Dimension | Dimension (SI) |
|---|---|---|---|
| 652 | Chamfer | 0.03" × 45 degrees | 0.0762 cm × 45 degrees |
| 654 | Radius | 1.563" +/− 0.001" | 3.97 cm +/− 0.00254 cm |
| 656 | Radius Center Offset from Upper End | 0.75" | 1.905 cm |
| 658 | Radius Center Offset From Inner Portion | 1.481" | 3.762 cm |

TABLE 13

Figure 32B:
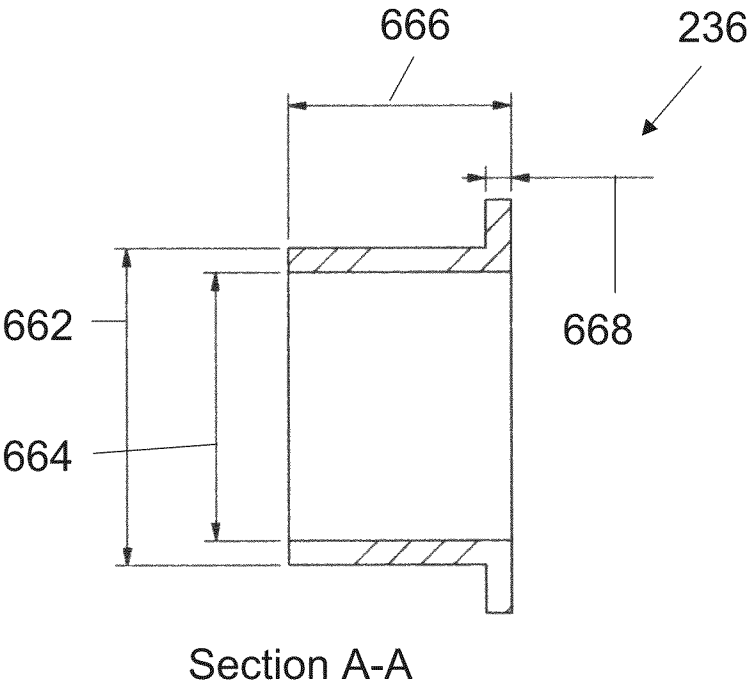
FIG. 32B is a cross-sectional view of a seal in accordance with an embodiment of the present disclosure.
Figure 32A:
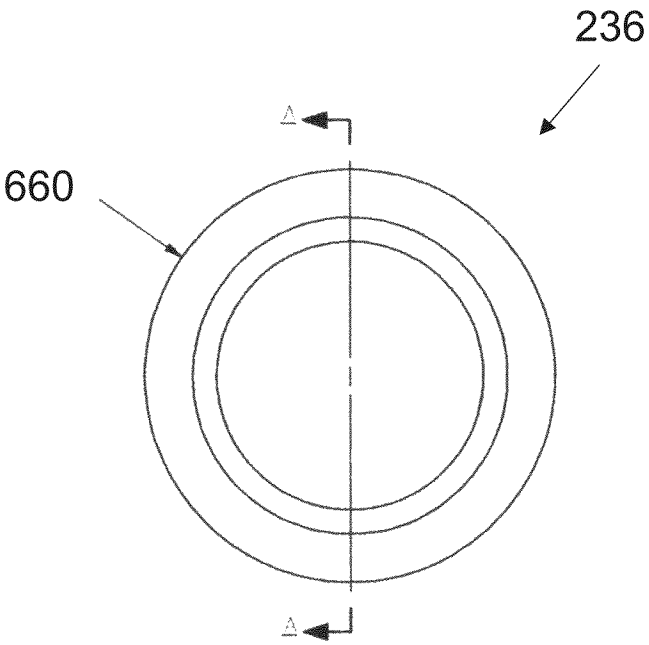
FIG. 32A is an elevation view of a seal in accordance with an embodiment of the present disclosure.

Dimensions of a seal 236 shown in FIGS. 32A and 32B.

| Ref. No. | Description | Dimension | Dimension (SI) |
|---|---|---|---|
| 660 | Outer Diameter | 4.4" | 11.18 cm |
| 662 | Shaft Portion Outer Diameter | 3.375" | 8.573 cm |
| 664 | Inner Diameter | 2.855" +0.000" −0.005" | 7.252 cm +0.0000 cm −0.0127 cm |
| 666 | Overall Length | 2.375" | 6.0325 cm |
| 668 | End Portion Length | 0.275" +0.005" −0.000" | 0.6985 cm +0.0127 cm −0.0000 cm |

TABLE 14

Figure 33B:
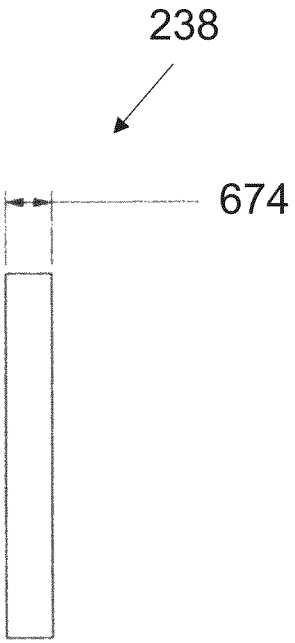
FIG. 33B is a further elevation view of a split ring in accordance with an embodiment of the present disclosure.
Figure 33A:
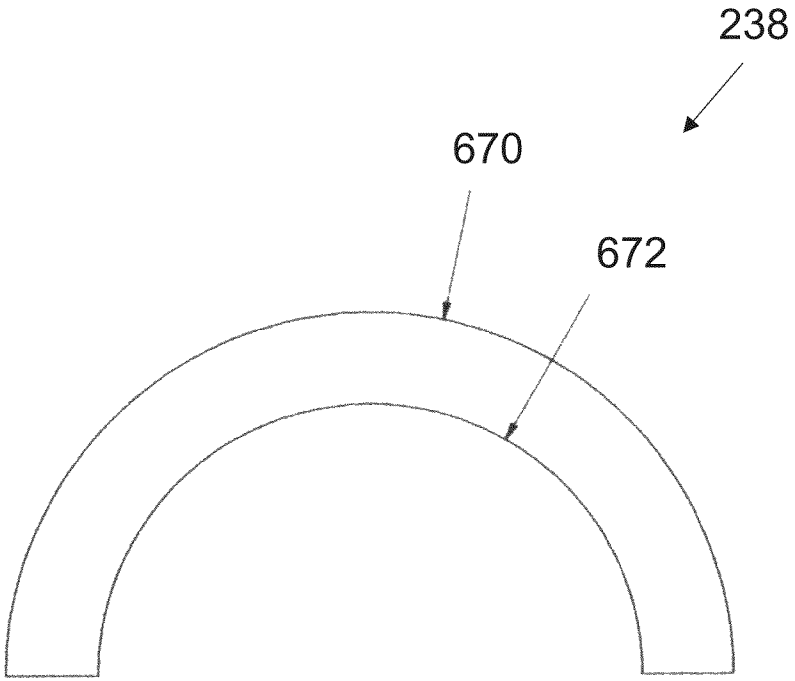
FIG. 33A is an elevation view of a split ring in accordance with an embodiment of the present disclosure.

Dimensions of a split ring 238 shown in FIGS. 33A and 33B.

| Ref. No. | Description | Dimension | Dimension (SI) |
|---|---|---|---|
| 670 | Outer Diameter | 3.975" +0.015" −0.000" | 10.097 cm +0.0381 cm −0.0000 cm |
| 672 | Inner Diameter | 2.975" +0.010" −0.000" | 7.557 cm +0.0254 cm −0.0000 cm |
| 674 | Length | 0.25" to 0.5" +0.005" −0.010" | 0.0635 cm to 0.127 cm +0.0127 cm −0.0254 cm |

TABLE 15

Figure 34B:
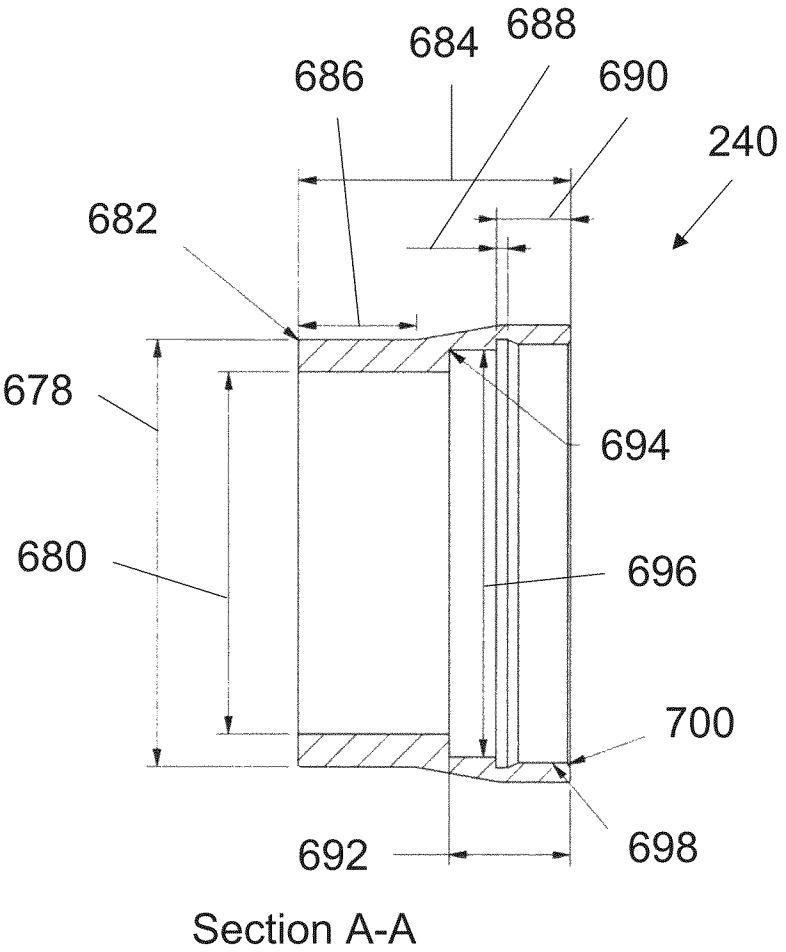
FIG. 34B is a cross-sectional view of a bonnet in accordance with an embodiment of the present disclosure.
Figure 34A:
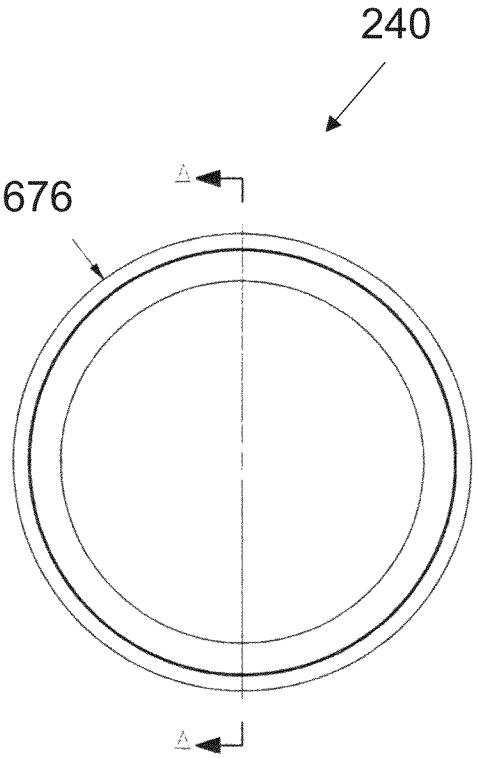
FIG. 34A is an elevation view of a bonnet in accordance with an embodiment of the present disclosure.

Dimensions of a bonnet 240 shown in FIGS. 34A and 34B.

| Ref. No. | Description | Dimension | Dimension (SI) |
|---|---|---|---|
| 676 | Outer Diameter | 4.95" | 12.573 cm |
| 678 | Outer Diameter at First End | 4.625" | 11.748 cm |
| 680 | Inner Diameter at First End | 3.92" | 9.96 cm |
| 682 | Chamfer | 0.02" × 45 degrees | 0.051 cm × 45 degrees |
| 684 | Overall Length | 2.95" | 7.493 cm |
| 686 | Length to Taper | 1.278" | 3.246 cm |
| 688 | Length of Flat Portion | 0.125" | 0.3175 cm |
| 690 | Length to Flat Portion | 0.81" | 2.057 cm |
| 692 | Length to Shoulder | 1.32" | 3.353 cm |
| 694 | Turn Relief | — | — |
| 696 | Inner Diameter | 4.41" | 11.20 cm |

TABLE 15-continued

| Dimensions of a bonnet 240 shown in FIGS. 34A and 34B. | | | |
|---|---|---|---|
| Ref. No. | Description | Dimension | Dimension (SI) |
| 698 | Thread Characteristics | 4.625" 8P Stub ACME RH Minor 4.53" +0.005" −0.000" | 11.748 cm 8P Stub ACME RH Minor 11.51 cm +0.0127 cm −0.0000 cm |
| 700 | Chamfer | 0.07" × 45 degrees | 0.178 cm × 45 degrees |

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A pack system for use in a downhole assembly, the pack system comprising:

a mandrel extending between an upper end and a lower end, the mandrel having an outer surface and having an inner surface that defines a central cavity that extends from the upper end to the lower end;

a bearing adapter connected to the upper end of the mandrel, the bearing adapter having at least one slot extending from an outer surface of the bearing adapter to an enclosed volume in the bearing adapter, wherein the enclosed volume is in fluid communication with the central cavity of the mandrel, the bearing adapter also having a shaft cavity at an upper end of the bearing adapter;

a shaft operably engaged with the shaft cavity of the bearing adapter such that a torque applied to the shaft is transmitted to the bearing adapter and to the mandrel, wherein a lower end of the shaft is positioned in the shaft cavity against a concave surface of a seat, the shaft having a plurality of protrusions extending outwardly from the shaft and positioned in corresponding plurality of channels of the shaft cavity of the bearing adapter;

a bearing housing disposed about the mandrel to define an annular space between an inner surface of the bearing housing and the outer surface of the mandrel;

at least one bearing positioned in the annular space to support at least one load on the mandrel, wherein the at least one bearing is not attached to a seal and is not positioned adjacent to a seal, wherein a first portion of a drilling fluid is configured to flow through the at least one slot of the bearing adapter, the enclosed volume of the bearing adapter, and the central cavity of the mandrel to cool a drill bit, and a second portion of the drilling fluid is configured to flow through the annular space between the bearing housing and the mandrel to lubricate the at least one bearing, wherein the at least one bearing comprises:

a lower radial bearing that supports a radial load on the mandrel; and a thrust bearing that supports an axial load on the mandrel; and a thrust ring positioned between the thrust bearing and a shoulder of the bearing housing, wherein the thrust ring distributes load forces about a circumference of the mandrel, and wherein at least one notch extends into an outer surface of the thrust ring and at least one notch extends into an inner surface of the thrust ring to channel the second portion of the drilling mud into the thrust bearing.

2. The pack system of claim 1, wherein the mandrel extends along a longitudinal axis and the mandrel rotates around the longitudinal axis, wherein the shaft extends along a shaft axis and the shaft rotates around the shaft axis, and wherein the mandrel longitudinal axis and the shaft axis are positioned at an angle greater than zero as measured from a point where the mandrel longitudinal axis and the shaft axis intersect one another.

3. The pack system of claim 1, wherein the mandrel, the bearing adapter, and the shaft rotate at a first speed, and the bearing housing rotates at a slower, second speed.

4. The pack system of claim 3, wherein the first speed is between 80 RPM and 120 RPM, and the second speed is between 40 RPM and 60 RPM.

5. A pack system for use in a downhole assembly, the pack system comprising:

a mandrel extending between an upper end and a lower end, the mandrel having an outer surface and having an inner surface that defines a central cavity that extends from the upper end to the lower end, wherein the mandrel extends along a longitudinal axis and the mandrel rotates around the longitudinal axis;

a bearing adapter connected to the upper end of the mandrel, the bearing adapter having at least one slot extending from an outer surface of the bearing adapter to an enclosed volume in the bearing adapter, wherein the enclosed volume is in fluid communication with the central cavity of the mandrel, the bearing adapter also having a shaft cavity at an upper end of the bearing adapter;

a shaft operably engaged with the shaft cavity of the bearing adapter such that a torque applied to the shaft is transmitted to the bearing adapter and to the mandrel, wherein a lower end of the shaft is positioned in the shaft cavity against a concave surface of a seat, the shaft having a plurality of protrusions extending outwardly from the shaft and positioned in corresponding plurality of channels of the shaft cavity of the bearing adapter, wherein the shaft extends along a shaft axis and the shaft rotates around the shaft axis, and wherein the longitudinal axis and the shaft axis are positioned at an angle greater than zero as measured from a point where the mandrel longitudinal axis and the shaft axis intersect one another;

a bearing housing disposed about the mandrel to define an annular space between an inner surface of the bearing housing and the outer surface of the mandrel; and at least one bearing positioned in the annular space to support at least one load on the mandrel, wherein the annular space does not contain seals, wherein a first portion of a drilling fluid is configured to flow through the at least one slot of the bearing adapter, the enclosed volume of the bearing adapter, and the central cavity of the mandrel to cool a drill bit, and a second portion of the drilling fluid is configured to flow through the annular space between the bearing housing and the mandrel to lubricate the at least one bearing.

6. The pack system of claim 5, wherein the at least one bearing comprises a thrust bearing that supports an axial load on the mandrel.

7. The pack system of claim 6, further comprising a thrust ring positioned between the thrust bearing and a shoulder of the bearing housing, wherein the thrust ring distributes load forces about a circumference of the mandrel, and wherein at least one notch extends into an outer surface of the thrust ring and at least one notch extends into an inner surface of the thrust ring to channel the second portion of the drilling mud into the thrust bearing.

8. The pack system of claim 6, wherein the at least one bearing further comprises a lower radial bearing that supports a radial load on the mandrel.

9. The pack system of claim 5, wherein the at least one bearing comprises a lower radial bearing that supports a radial load on the mandrel.

10. The pack system of claim 5, wherein the mandrel, the bearing adapter, and the shaft rotate at a first speed, and the bearing housing rotates at a slower, second speed.

11. The pack system of claim 10, wherein the first speed is between 80 RPM and 120 RPM, and the second speed is between 40 RPM and 60 RPM.

12. A pack system for use in a downhole assembly, the pack system comprising:

a mandrel extending between an upper end and a lower end, the mandrel having an outer surface and having an inner surface that defines a central cavity that extends from the upper end to the lower end;

a bearing adapter connected to the upper end of the mandrel, the bearing adapter having at least one slot extending from an outer surface of the bearing adapter to an enclosed volume in the bearing adapter, wherein the enclosed volume is in fluid communication with the central cavity of the mandrel, the bearing adapter also having a shaft cavity at an upper end of the bearing adapter;

a shaft operably engaged with the shaft cavity of the bearing adapter such that a torque applied to the shaft is transmitted to the bearing adapter and to the mandrel, wherein a lower end of the shaft is positioned in the shaft cavity against a concave surface of a seat, the shaft having a plurality of protrusions extending outwardly from the shaft and positioned in corresponding plurality of channels of the shaft cavity of the bearing adapter;

a bearing housing disposed about the mandrel to define an annular space between an inner surface of the bearing housing and the outer surface of the mandrel; and at least one bearing positioned in the annular space to support at least one load on the mandrel, wherein the at least one bearing is not attached to a seal and is not positioned adjacent to a seal, wherein a first portion of a drilling fluid is configured to flow through the at least one slot of the bearing adapter, the enclosed volume of the bearing adapter, and the central cavity of the mandrel to cool a drill bit, and a second portion of the drilling fluid is configured to flow through the annular space between the bearing housing and the mandrel to lubricate the at least one bearing, wherein the mandrel, the bearing adapter, and the shaft rotate at a first speed, and the bearing housing rotates at a slower, second speed.

13. The pack system of claim 12, wherein the at least one bearing comprises a thrust bearing that supports an axial load on the mandrel.

14. The pack system of claim 13, further comprising a thrust ring positioned between the thrust bearing and a shoulder of the bearing housing, wherein the thrust ring distributes load forces about a circumference of the mandrel, and wherein at least one notch extends into an outer surface of the thrust ring and at least one notch extends into an inner surface of the thrust ring to channel the second portion of the drilling mud into the thrust bearing.

15. The pack system of claim 13, wherein the at least one bearing further comprises a lower radial bearing that supports a radial load on the mandrel.

16. The pack system of claim 12, wherein the at least one bearing comprises a lower radial bearing that supports a radial load on the mandrel.

17. The pack system of claim 12, wherein the mandrel extends along a longitudinal axis and the mandrel rotates around the longitudinal axis, wherein the shaft extends along a shaft axis and the shaft rotates around the shaft axis, and wherein the mandrel longitudinal axis and the shaft axis are positioned at an angle greater than zero as measured from a point where the mandrel longitudinal axis and the shaft axis intersect one another.

18. The pack system of claim 12, wherein the first speed is between 80 RPM and 120 RPM, and the second speed is between 40 RPM and 60 RPM.

* * * * *